US005630013A

United States Patent [19]

Suzuki et al.

[11] Patent Number: 5,630,013

[45] Date of Patent: May 13, 1997

[54] METHOD OF AND APPARATUS FOR PERFORMING TIME-SCALE MODIFICATION OF SPEECH SIGNALS

[75] Inventors: Ryoji Suzuki, Nara; Masayuki Misaki, Kobe, both of Japan

[73] Assignee: Matsushita Electric Industrial Co., Ltd., Kadoma, Japan

[21] Appl. No.: 187,295

[22] Filed: Jan. 25, 1994

[30] Foreign Application Priority Data

Jan. 25, 1993 [JP] Japan ..... 5-009737
Jun. 21, 1993 [JP] Japan ..... 5-149224

[51] Int. Cl.[6] ..... G10L 3/02

[52] U.S. Cl. ..... 395/2.25

[58] Field of Search ..... 381/34; 395/2.25

[56] References Cited

U.S. PATENT DOCUMENTS

| | | | |
|---|---|---|---|
| 3,786,195 | 1/1974 | Schiffman | 179/15.55 T |
| 4,246,617 | 1/1981 | Portnoff | 360/32 |
| 4,464,784 | 8/1984 | Agnello | 381/61 |
| 4,722,009 | 1/1988 | Nakama et al. | 360/8 |
| 4,864,620 | 9/1989 | Bialick | 381/34 |
| 5,175,769 | 12/1992 | Hejna et al. | 381/34 |
| 5,341,432 | 8/1994 | Suzuki et al. | 381/34 |

FOREIGN PATENT DOCUMENTS 0427953 5/1991 European Pat. Off. .

OTHER PUBLICATIONS

Search Report for European Appl. 94101057.1, mailed Dec. 8, 1994.

Suzuki et al, "Time Scale Modification of Speech Signals Using Cross–Correlation," IEEE 1992, Intl' Conference on consumer Electronics Digest of Tech. Papers, Jun. 2–4, 1992, pp. 166–167.

Takasugi et al; "Function of SPAC (Speech Processing System by Use of Autocorrelation Function) and Fundamental Characteristics", IECE of Japan, vol. E62, No. 3., pp. 153–154.

Jianping, "Effective Time–Domain Method for Speech Rate Change", May 1988, pp. 339–346, IEEE Transactions on Consumer Electronics, vol. 34, No. 2.

Makhoul, "Time–Scale Modification in Medium to Low Rate Speech Coding", ICASSP 86, Tokyo, pp. 1705–1707.

Cox et al; "Real–Time Implementation of Time Domain Harmonic Scaling of Speech for Rate Modification and Coding", IEEE Transactions vol. ASSP–31, No. 1, Feb. 1983.

Beranek et al; "High Quality Time–Scale Modification for Speech", IEEE, 1985, pp. 493–496.

Suzuki et al., "Time–Scale Modification of Speed Signals using Cross–Correlation Function", IEEE 1991, Jun. 5, 1992, pp. 357–363.

*Primary Examiner*—Allen R. MacDonald
*Assistant Examiner*—Thomas J. Onka
*Attorney, Agent, or Firm*—Renner, Otto, Boisselle & Sklar, P.L.L.

[57] ABSTRACT

An apparatus for transforming an input signal having a time length L into an output signal having a time length $\alpha L$ in accordance with a given time-scale modification ratio $\alpha$, including a correlator for calculating a value of a correlation function between a first signal and a second signal having a time length T and for determining a time delay $T_c$ at which the value of the correlation function becomes the greatest; an adder for adding the first signal multiplied by a first window function to the second signal multiplied by a second window function with a displacement of the time delay $T_c$; and an outputting circuit for selectively outputting the output of the adder and a third signal succeeding the output of the adder so that the sum of a time length of the output of the adder and a time length of the third signal is substantially equal to a time length defined by the time-scale modification ratio $\alpha$, the time delay $T_c$ and the time length T.

13 Claims, 18 Drawing Sheets

Tc=0

Tc>0

Tc<0

METHOD OF AND APPARATUS FOR PERFORMING TIME-SCALE MODIFICATION OF SPEECH SIGNALS

BACKGROUND OF THE INVENTION

1. Field of the Invention

The present invention relates to a method of and an apparatus for performing time-scale modification of a speech signal, whereby the time duration of the speech signal is changed without changing the fundamental frequency components of the speech signal.

2. Description of the Related Art

Conventionally, in order to playback a speech signal recorded on audio tapes or the like at a higher speed or a lower speed for listeners, a speech time modification apparatus has been utilized.

One such speech time-scale modification apparatus is disclosed in U.S. Pat. No. 3,786,195, "VARIABLE DELAY LINE SIGNAL PROCESSOR FOR SOUND REPRODUCTION." This speech time-scale modification apparatus includes a variable delay line, a ramp level and amplitude changer, a blanking circuit, a blanking pulse generator, and a ramp pulse-train generator.

The operation of the speech time-scale modification apparatus having the above configuration will be described below.

First, an input signal is written into the variable delay line. Next, the ramp pulse-train generator controls the ramp level and amplitude changer and the blanking pulse generator in accordance with the time-scale modification ratio. The ramp level and amplitude changer then reads the input signal from the variable delay line at a speed which is different from a speed in writing in accordance with the time-scale modification ratio. Specifically, for a playback of a speech signal at a higher speed, reading is done at a lower rate than writing, and for a playback of a speech signal at a lower speed, reading is done at a higher rate than writing. At discontinuous portions between blocks, the blanking circuit applies the muting action to the output of the variable delay line.

With the above configuration, however, problems arise when the speed is increased; that is, the recognizability of consonants, etc. degrades because of data decimation, and furthermore, since the muting is performed at discontinuous portions between blocks, discontinuities are introduced in signal amplitude, resulting in speech reproduction lacking in naturalness.

Another technique of speech time-scale modification is disclosed in "Real-Time Implementation of Time Domain Harmonic Scaling of Speech for Rate Modification and Coding" by R. V. Cox et al., IEEE TRANSACTIONS ON ACOUSTICS, SPEECH, AND SIGNAL PROCESSING, VOL. ASSP-31, No. 1, pp. 258–272, February 1983.

This speech time-scale modification technique is called Time Domain Harmonic Scaling (TDHS), in which a pitch period p is extracted from an input signal S(n) and each input signal S(n) is weighted with a triangular window ($W_c(n)$ or $W_e(n)$) and added, so as to obtain an output signal (($S_c(n)$ or $S_e(n)$).

$$S_c(n)=W_c(n)S(n)+[1-W_c(n)]S(n+p)\text{(time-scale compression)}$$

$$S_e(n)=W_e(n)S(n)+[1-W_e(n)]S(n-p)\text{(time scale compression)}$$

Herein, the triangular window ($W_c(n)$ or $W_e(n)$) is obtained from the following equation:

$$W_c(n)=1-n/(B_c-1)\ n=0, 1, \ldots Bc \text{ (time-scale compression)},$$

$$W_e(n)=1-n/(B_e-1)\ n=0, 1, \ldots Be \text{ (time-scale expansion)},$$

where the window length is determined by the following equation:

$B_c=p/(1/\alpha-1)$ (time-scale compression), $B_e=\alpha p/(\alpha-1)$ (time-scale expansion), $B_c$: window length (time-scale compression), $B_e$: window length (time-scale expansion), p: pitch period, $\alpha$: time-scale modification ratio=(output time duration)/(input time duration).

The TDHS uses a pitch period, but it is difficult to accurately extract the pitch period. In particular, it is extremely difficult to extract a pitch period from a music signal or a signal superposed with noise. As a result, it is difficult to sample an input signal using the length ($B_c$ or $B_e$) that is set in terms of the pitch period p, and by overlapping or connecting input signals sampled on the basis of an incorrect pitch period, an output signal of good quality cannot be obtained.

Furthermore, the processing of the TDHS is performed on the premise that an input signal sampled using a triangular window has a constant pitch period within that window; in reality, however, when the time-scale modification ratio $\alpha$ is in the neighborhood of 1, the window length becomes longer (for example, $B_c$=9p for $\alpha$=0.9 and $B_e$=11p for $\alpha$=1.1), and it is unlikely that the pitch period of speech should stay constant over such a long time segment. This results in further degradation of sound quality.

Moreover, since all the output signals are constructed with signals sampled while weighting the input signals with triangular windows, the whole process involves an increased number of processing steps, so that sound quality degrades significantly as a result of the processing.

SUMMARY OF THE INVENTION

The apparatus of this invention for transforming an input signal having a time length L into an output signal having a time length $\alpha$L in accordance with a given time-scale modification ratio $\alpha$, includes: an input section for inputting a first signal which has a time length T and a second signal which has the time length T and succeeds the first signal; a correlator for calculating a value of a correlation function between the first signal and the second signal and for determining a time delay $T_c$ at which the value of the correlation function becomes the greatest; a window function generator for generating a first window function and a second window function according to the time-scale modification ratio $\alpha$ and the time delay $T_c$; a first multiplier for multiplying the first signal by the first window function; a second multiplier for multiplying the second signal by the second window function; an adder for adding the output of the first multiplier to the output of the second multiplier with a displacement of the time delay $T_c$; and an outputting section for selectively outputting the output of the adder and a third signal succeeding the output of the adder so that the sum of a time length of the output of the adder and a time length of the third signal is substantially equal to a time length defined by the time-scale modification ratio $\alpha$, the time delay $T_c$ and the time length T.

In another aspect of the present invention, a method for transforming an input signal having a time length L into an output signal having a time length $\alpha$L in accordance with a given time-scale modification ratio $\alpha$, includes the steps of: (a) inputting a first signal which has a time length T from a starting point and a second signal which has the time length T and succeeds the first signal; (b) calculating a value of a correlation function between the first signal and the second signal and determining a time delay $T_c$ at which the value of the correlation function becomes the greatest; (c) generating a first window function and a second window function according to the time-scale modification ratio $\alpha$ and the time delay $T_c$; (d) obtaining a first multiplied result by multiplying the first signal by the first window function; (e) obtaining a second multiplied result by multiplying the second signal by the second window function; (f) obtaining an added result by adding the first multiplied result to the second multiplied result with a displacement of the time delay $T_c$; (g) selectively outputting the added result and a third signal succeeding the added result so that the sum of a time length of the added result and a time length of the third signal is substantially equal to a predetermined first time length defined by the time-scale modification ratio $\alpha$, the time delay $T_c$ and the time length T; (h) adding a predetermined second time length defined by the time-scale modification ratio $\alpha$, the time delay $T_c$ and the time length T to the starting point of the first signal; and (i) repeating step (a) to step (h).

In one embodiment, the time-scale modification ratio $\alpha$ satisfies a condition of $\alpha \geqq 1$, the first window function monotonically increases and the second window function monotonically decreases in a manner complementary to the first window function, the predetermined first time length is represented by $\alpha(T-T_c)/(\alpha-1)$, said third signal is a signal exceeding said first signal the predetermined second time length is represented by $(T-T_c)/(\alpha-1)$.

In another embodiment, the time-scale modification ratio satisfies a condition of $\alpha \geqq 1$, the first window function monotonically decreases and the second window function monotonically increases in a manner complementary to the first window function, the predetermined first time length is represented by an equation of $\alpha(T-T_c)/(1-\alpha)$, said third signal is a signal exceeding said second signal the predetermined second time length is represented by an equation of $(T-T_c)/(1-\alpha)$.

In another aspect of the present invention, an apparatus for transforming an input signal having a time length L into an output signal having a time length $\alpha L$ in accordance with a given time-scale modification ratio $\alpha$ includes: an input section for inputting a first signal which has a time length M ($T \leqq M < 2T$) and a second signal which has the time length M, the starting point of the second signal being delayed from the starting point of the first signal by a time length T; a correlator for calculating a value of a correlation function between the first signal and the second signal and for determining a time delay $T_c$ at which the value of the correlation function becomes the greatest; a window function generator for generating a first window function and a second window function according to the time-scale modification ratio $\alpha$ and the time delay $T_c$; a reading circuit for reading a portion of the first signal and a portion of the second signal according to the time delay $T_c$; a first multiplier for multiplying the portion of the first signal by the first window function; a second multiplier for multiplying the portion of the second signal by the second window function; an adder for adding the output of the first multiplier to the output of the second multiplier with a displacement of the time delay $T_c$ and with an overlap of the time length T; and an outputting section for selectively outputting the output of the adder and a third signal succeeding the output of the adder so that the sum of a time length of the output of the adder and a time length of the third signal is substantially equal to a time length defined by the time-scale modification ratio $\alpha$, the time delay $T_c$ and the time length T.

In another aspect of the present invention, a method for transforming an input signal having a time length L into an output signal having a time length $\alpha L$ in accordance with a given time-scale modification ratio $\alpha$ which satisfies a condition of $\alpha \geqq 1$, includes the steps of: (a) inputting a first signal which has a time length T from a starting point and a second signal which has the time length T and succeeds the first signal; (b) calculating a value of a correlation function between the first signal and the second signal and determining a time delay $T_c$ at which the value of the correlation function becomes the greatest; (c) obtaining a third signal which has the time length T and delays from the first signal by the time delay $T_c$ and a fourth signal which has the time length T and delays from the second signal by the time delay $(-T_c)$; (d) generating a first window function which monotonically increases and a second window function which monotonically decreases in a manner complementary to the first window function according to the time-scale modification ratio $\alpha$ and the time delay $T_c$; (e) performing a first output step, when the time delay $T_c$ satisfies a condition of $T_c<0$, the first step including the steps of: (e1) obtaining a fifth signal which has the time length $(-T_c)$ from a start point of the second signal; (e2) obtaining a first multiplied result by multiplying the first signal by the first window function; (e3) obtaining a second multiplied result by multiplying the fourth signal by the second window function; (e4) obtaining an added result by adding the first multiplied result to the second multiplied result; and (e5) selectively outputting the fifth signal, the added result and a sixth signal succeeding the first signal so that the sum of a time length of the fifth signal, a time length of the added result and a time length of the sixth signal is substantially equal to a predetermined firs time length defined by the time-scale modification ratio $\alpha$, the time delay $T_c$ and the time length T; (f) performing a second output step, when the time delay $T_c$ satisfies a condition of $T_c \geqq 0$, the second step including the steps of: (f1) obtaining a first multiplied result by multiplying the third signal by the first window function; (f2) obtaining a second multiplied result by multiplying the second signal by the second window function; (f3) obtaining an added result by adding the first multiplied result to the second multiplied result; and (f4) selectively outputting the added result and a seventh signal succeeding the third signal so that the sum of a time length of the added result and a time length of the seventh signal is substantially equal to a predetermined first time length defined by the time-scale modification ratio $\alpha$, the time delay $T_c$ and the time length T; (g) adding a predetermined second time length defined by the time-scale modification ratio $\alpha$, the time delay $T_c$ and the time length T to the starting point of the first signal; and (h) repeating step (a) to step (g).

In one embodiment, the predetermined first time length is represented by an equation of $\alpha(T-T_c)/(\alpha-1)$ and the predetermined second time length is represented by an equation of $(T-T_c)/(\alpha-1)$.

In another embodiment, the step (b) includes the steps of: calculating a value of a correlation function between the first signal and a signal which has the time length T and delays from the second signal by $(-\tau)$ for $-T<\tau<0$; calculating a value of said correlation function between the second signal and a signal which has the time length T and delays from the first signal by $\tau$ for $0 \leqq \tau < T$; determining a time delay $T_c$ at which the value of the correlation function becomes the greatest for $-T<\tau<T$.

In another embodiment, the correlation function is defined by:

$$R(\tau)=\sum_{m=0}^{T-1} x(ip1+m)\cdot x(ip2-\tau+m)$$

for $-T<\tau<0$; and $$R(\tau)=\sum_{m=0}^{T-1} x(ip1+\tau+m)\cdot x(ip2+m)$$

for $0\leqq\tau<T$;

where, ip1 denotes a starting point of said first signal and ip2 denotes a stating point of said second signal.

In another aspect of the present invention, a method for transforming an input signal having a time length L into an output signal having a time length $\alpha L$ in accordance with a given time-scale modification ratio $\alpha$ which satisfies a condition of $\alpha\leqq 1$, the method includes the steps of: (a) inputting a first signal which has a time length T from a starting point and a second signal which has the time length T and succeeds the first signal; (b) calculating a value of a correlation function between the first signal and the second signal and determining a time delay $T_c$ at which the value of the correlation function becomes the greatest; (c) obtaining a third signal which has the time length T and delays from the first signal by the time delay $T_c$ and a fourth signal which has the time length T and delays from the second signal by the time delay $(-T_c)$; (d) generating a first window function which monotonically decreases and a second window function which monotonically increases in a manner complementary to the first window function according to the time-scale modification ratio $\alpha$ and the time delay $T_c$; (e) performing a first output step, when the time delay $T_c$ satisfies a condition of $T_c>0$, the first step including the steps of: (e1) obtaining a fifth signal which has the time length $T_c$ from a start point of the first signal; (e2) obtaining a first multiplied result by multiplying the third signal by the first window function; (e3) obtaining a second multiplied result by multiplying the second signal by the second window function; (e4) obtaining an added result by adding the first multiplied result to the second multiplied result; and (e5) selectively outputting the fifth signal, the added result and a sixth signal succeeding the second signal so that the sum of a time length of the fifth signal, a time length of the added result and a time length of the sixth signal is substantially equal to a predetermined first time length defined by the time-scale modification ratio $\alpha$, the time delay $T_c$ and the time length T; (f) performing a second output step, when the time delay $T_c$ satisfies a condition of $T_c\leqq 0$, the second step including the steps of: (f1) obtaining a first multiplied result by multiplying the first signal by the first window function; (f2) obtaining a second multiplied result by multiplying the fourth signal by the second window function; (f3) obtaining an added result by adding the first multiplied result to the second multiplied result; and (f4) selectively outputting the added result and a seventh signal succeeding the fourth signal so that the sum of a time length of the added result and a time length of the seventh signal is substantially equal to a predetermined first time length defined by the time-scale modification ratio $\alpha$, the time delay $T_c$ and the time length T; (g) adding a predetermined second time length defined by the time-scale modification ratio $\alpha$, the time delay $T_c$ and the time length T to the starting point of the first signal; and (h) repeating step (a) to step (g).

In one embodiment, the predetermined first time length is represented by an equation of $\alpha(T-T_c)/(1-\alpha)$ and the predetermined second time length is represented by an equation of $(T-T_c)/(1-\alpha)$.

In another embodiment, the step (b) includes the steps of: calculating a value of a correlation function between the first signal and a signal which has the time length T and delays from the second signal by $(-\tau)$ for $-T<\tau<0$; calculating a value of said correlation function between the second signal and a signal which has the time length T and delays from the first signal by $\tau$ for $0\leqq\tau<T$; determining a time delay $T_c$ at which the value of the correlation function becomes the greatest for $-T<\tau<T$.

In another embodiment, the correlation function is defined by:

$$R(\tau)=\sum_{m=0}^{T-1} x(ip1+m)\cdot x(ip2-\tau+m)$$

for $-T<\tau<0$; and $$R(\tau)=\sum_{m=0}^{T-1} x(ip1+\tau+m)\cdot x(ip2+m)$$

for $0\leqq\tau<T$;

where, ip1 denotes a starting point of the first signal and ip2 denotes a stating point of the second signal.

According to the above-described configuration, since the first signal and the second signal are added together after being multiplied by the window functions whose amplitudes vary in complementary manner, the signal produced by the addition is less prone to amplitude discontinuity, and since the first signal and the second signal multiplied by their respective window functions are added together at the position of the time delay $T_c$ at which the value of the correlation function becomes the greatest, the number of occurrences of phase discontinuity is reduced; furthermore, since the signal resulting from the addition of the first signal and the second signal multiplied by their respective window functions, and the third signal succeeding this resulting signal are output for the time duration determined on the basis of the time-scale modification ratio $\alpha$ the time delay $T_c$ at which the value of the correlation function becomes the greatest, and the time length T, a desired time-scale modification can be accomplished without significant loss of signals.

Thus, the invention described herein makes possible the advantage of providing a method of and an apparatus for performing time-scale modification of speech signals, capable of producing natural sounding speech with reduced occurrences of signal discontinuity and without significant data loss.

This and other advantages of the present invention will become apparent to those skilled in the art upon reading and understanding the following detailed description with reference to the accompanying figures.

DESCRIPTION OF THE PREFERRED EMBODIMENTS

A first embodiment of the speech time-scale modification apparatus and method of the invention will be described below with reference to drawings.

The present invention is intended to provide a speech time-scale modification apparatus and method that can be realized with simple hardware and that is capable of producing natural sounding speech with reduced occurrences of discontinuity in signal amplitude and phase and without significant loss of data.

Figure 1:
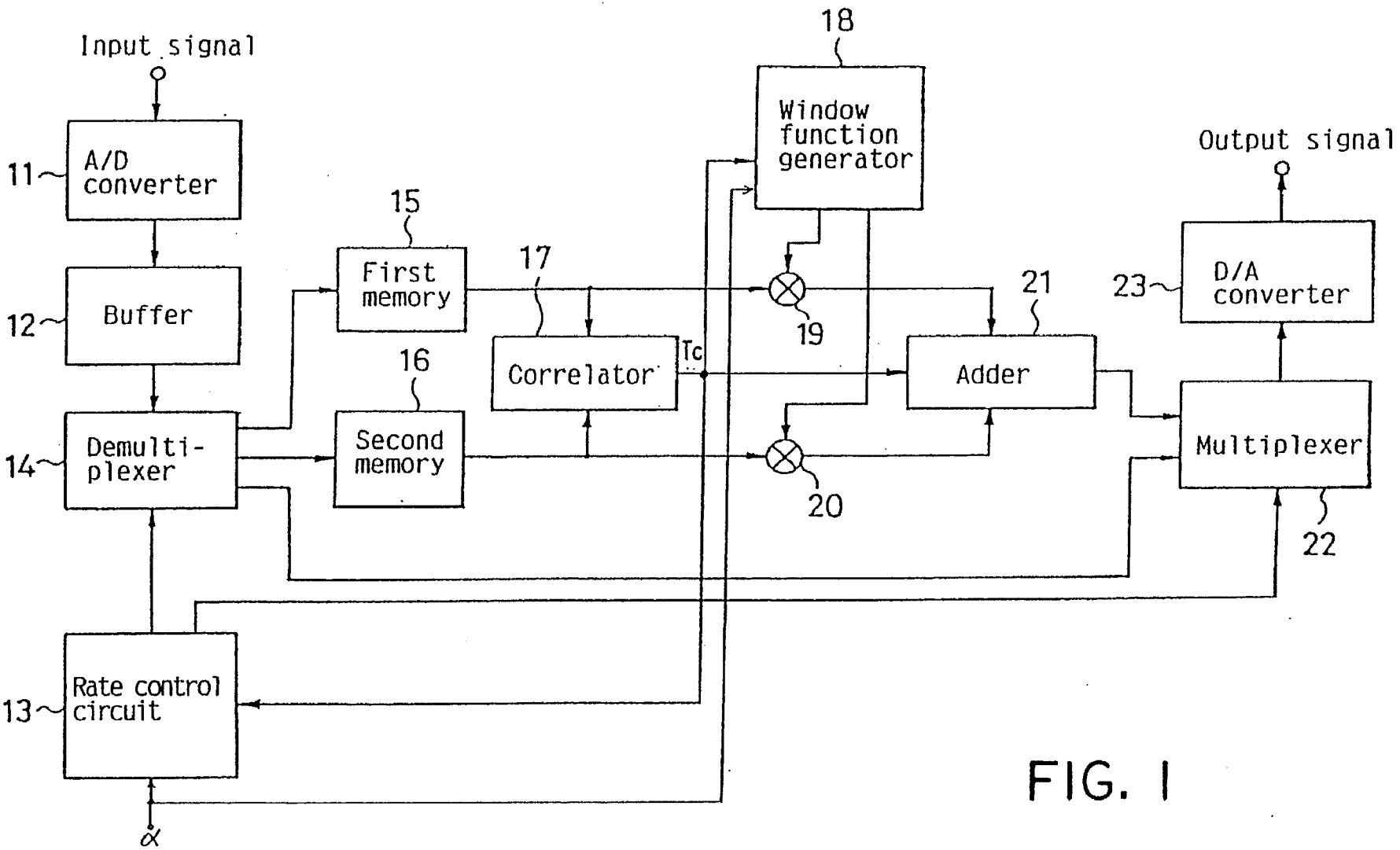
FIG. 1 is a block diagram showing the configuration of a speech time-scale modification apparatus according to a first embodiment of the invention.

FIG. 1 shows a configuration of a speech time-scale modification apparatus according to the first embodiment of the invention. As shown in FIG. 1, the speech time-scale modification apparatus includes an A/D converter 11, a buffer 12, a rate control circuit 13, a demultiplexer 14, a first memory 15 for storing an input signal having a time length T, a second memory 16 for storing an input signal having the time length T and succeeding the input signal stored in the first memory 15, a correlator 17 for outputting a correlation function between the contents of the first memory 15 and the contents of the second memory 16 and for determining a time delay $T_c$ at which the value of the correlation function becomes the greatest, a window function generator 18, a first multiplier 19, a second multiplier 20, an adder 21, a multiplexer 22 and a D/A converter 23.

The operation of the speech time-scale modification apparatus having the above configuration will be described below.

First, an input analog signal is converted by the A/D converter 11 into a digital signal, and then written into the buffer 12. The demultiplexer 14 passes the input signal stored in the buffer 12 to the first memory 15 for the duration of time length T, and then passes the input signal succeeding the contents of the first memory 15 to the second memory 16 for the duration of time length T.

The correlator 17 calculates the correlation function by displacing timewise the contents of the first memory 15 from the contents of the second memory 16, and determines the time delay $T_c$ at which the value of the correlation function becomes the greatest. The determined time delay $T_c$ is supplied to the rate control circuit 13, window function generator 18, and adder 21.

Based on the time delay $T_c$ from the correlator 17 and the time-scale modification ratio $\alpha$, the window function generator 18 generates a first window function whose amplitude gradually increases or decreases with time, and supplies the first window function to the first multiplier 19. The window function generator 18 also generates a second window function whose amplitude is complementary to the first window function, and supplies the second window function to the second multiplier 20. The first multiplier 19 multiplies the contents of the first memory 15 by the first window function from the window function generator 18, while the second multiplier 20 multiplies the contents of the second memory 16 by the second window function from the window function generator 18.

Based on the time delay $T_c$ from the correlator 17, the adder 21 adds the output of the first multiplier 19 and the output of the second multiplier 20 together, by shifting the latter from the former by the time delay $T_c$ at which the value of the correlation function becomes the greatest, and supplies the resulting sum to the multiplexer 22.

The rate control circuit 13 controls the demultiplexer 14 to pass the input signal stored in the buffer 12 to the multiplexer 22 so that the sum of the time length of the output of the adder 21 and the time length of the input signal succeeding the contents of the first or second memory 15 or 16 becomes equal to the time length determined on the basis of the time-scale modification ratio $\alpha$ (=output time duration/input time duration), the time delay $T_c$ from the correlator 17, and the time length T. Then, according to a control signal supplied from the rate control circuit 13, the multiplexer 22 switches between the output of the adder 21 and the output of the demultiplexer 14, and supplies the output to the D/A converter 23.

The D/A converter 23 converts the digital signal supplied from the multiplexer 22 into an analog signal. Finally, based on the time-scale modification ratio $\alpha$, the time delay $T_c$ from the correlator 17, and the time length T, the rate control circuit 13 determines the start position of the input signal to be passed from the buffer 12 to the first memory 15 in the next processing operation.

In this embodiment, since the contents of the buffer 12 are repeated as the contents of the first memory 15 and the contents of the second memory 16, the contents of the buffer 12 may be passed from the demultiplexer 14 directly to the correlator 17, the first multiplier 19, the second multiplier 20, and the multiplexer 22, respectively. The first memory 15 and the second memory 16 can then be eliminated.

Figure 2:
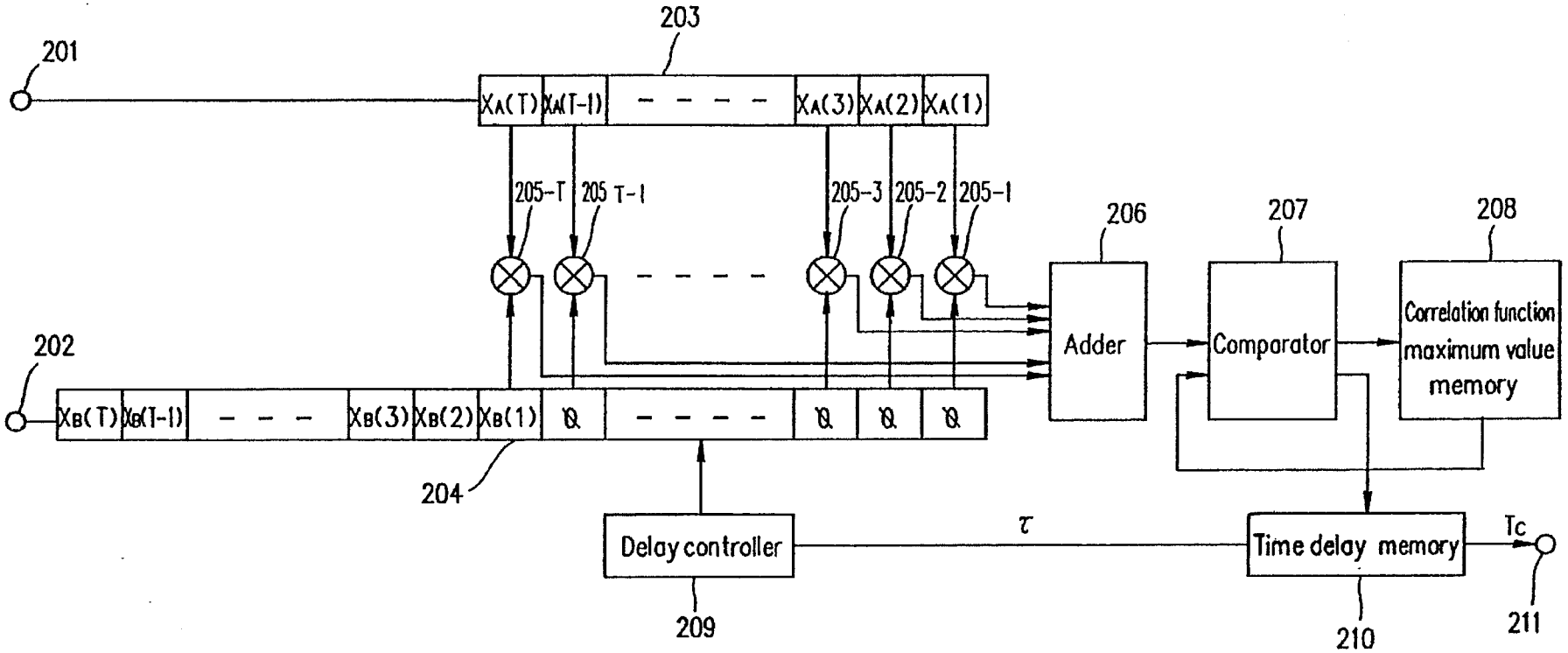
FIG. 2 is a block diagram showing the configuration of a correlator in the speech time-scale modification apparatus according to the first embodiment of the invention.

FIG. 2 shows a configuration of the correlator 17 in the speech time-scale modification apparatus according to the above embodiment of the invention. The speech time-scale modification apparatus includes an input terminal 201 for inputting the contents of the first memory 15, an input terminal 202 for inputting the contents of the second memory 16 and an output terminal 211. The speech time-scale modification apparatus further includes a memory 203 for storing the contents of the first memory 15 for the time length T, a shift register 204 having a time length of (2T−1) for storing the contents of the second memory 16 for the time length T and for introducing a delay by every sample, multipliers 2051–205T, arranged in an array, for multiplying the contents of the memory 203 by the contents of the shift register 204, an adder 206 for obtaining the total sum of the outputs of the multipliers 2051–205T, a comparator 207, a correlation function maximum value memory 208 for storing the maximum value of the output of the adder 206 supplied through the comparator 207, a delay controller 209 for controlling the time delay of the shift register 204 and a time delay memory 210 for storing the time delay of the shift register 204 at which the correlation function becomes the greatest.

The operation of the thus configured correlator 17 of the speech time-scale modification apparatus will be described below.

In initial conditions, the contents of the shift register 204 and the contents of the correlation function maximum value memory 208 are cleared to zero, and for the delay controller 209 and the time delay memory 210, the time delay $\tau$ is initialized to −T+1.

Then, the contents of the first memory 15 is applied at the input terminal 201 and transferred to the memory 203, while the contents of the second memory 16 is applied at the input terminal 202 and transferred to the leftmost position of the shift register 204. Next, the multipliers, 2051–205T, multiply the contents of the memory 203 by the contents of the shift register 204. The adder 206 calculates the total sum of the outputs of the multipliers 2051–205T, and outputs the total sum as a value of a correlation function at the time delay $\tau$.

The comparator 207 then compares the output of the adder 206 with the value stored in the correlation function maximum value memory 208. If the comparator 207 determines that the output of the adder 206 is greater than the value stored in the correlation function maximum value memory 208, the comparator 207 supplies the output of the adder 206 to the correlation function maximum value memory 208, and at the same time, controls the time delay memory 210 so as to store the output $\tau$ from the delay controller 209 as a time delay $T_c$ at which the value of the correlation function becomes the greatest.

Next, the delay controller 209 delays the contents of the shift register 204 one sample to the right and increments the time delay $\tau$ by 1. Then, the process returns to the step where the multipliers 2051–205T, multiply the contents of the memory 203 by the contents of the shift register 204. This process is repeated until just before the shift register 204 becomes empty ($\tau$=+T−1). When these repetitions are completed, the contents stored in the time delay memory 210 is output from the output terminal 211 as the time delay $T_c$ at which the value of the correlation function between the contents of the first memory 15 and the contents of the second memory 16 becomes the greatest.

In the above embodiment, the search range of the correlation function is set at $-T+1 \leqq \tau \leqq +T-1$, but this may be set at $-T+k \leqq \tau \leqq +T-j$ (where $T>k>1$, $T>j>1$). In the latter case, not only the time length of the shift register 204 can be shortened, but the number of times of correlation function calculations can also be reduced.

Furthermore, in the above embodiment, since the memory 203 is used to store the same contents as stored in the first memory 15, it may be configured so that the contents of the first memory 15 are input directly to the multipliers 2051–205T. In this case, the memory 203 can be eliminated.

Moreover, in the above embodiment, since the contents to be stored in the shift register 204 are the same as the contents stored in the second memory 16, it may be configured so that the contents of the second memory 16 are sequentially input to the multipliers 2051–205T each time the time delay $\tau$ is changed. In this case, the shift register 204 can be eliminated.

As mentioned above, according to the speech time-scale modification apparatus of the first embodiment of the invention, the first multiplier 19 and the second multiplier 20 multiply the contents of the first memory 15 and the contents of the second memory 16 with window functions whose amplitude gradually increase or decrease output from the window function generator 18. The adder 21 adds the outputs of the first multiplier 19 and the second multiplier 20 together. This makes it possible to output a natural sounding speech signal with reduced occurrences of discontinuity in signal amplitude and without significant loss of data.

Further, the correlator 17 calculates the correlation function between the contents of the first memory 15 and the contents of the second memory 16. The adder 21 adds the outputs of the first multiplier 19 and the second multiplier 20 together with a relative delay $T_c$ at which the value of the correlation function becomes the greatest. This makes it possible to output a speech signal with high quality and with reduced occurrences of discontinuity in signal phase.

Furthermore, the rate control circuit 13 controls the demultiplexer 14 and the multiplexer 22 so that the sum of the time length of the output of the adder 21, the time length of the input signal succeeding the contents of the first memory 15 or the contents of the second memory 16 from the buffer 12 is equal to a time length determined on the basis of the time-scale modification ratio $\alpha$, the time delay $T_c$ from the correlator 17 and the time length T. This makes it possible to easily change the time scale modification ratio, to absorb the displacement of the time scale modification ratio which is caused by adding the outputs of the first multiplier 19 and the second multiplier 20 together with a relative delay $T_c$ at which the value of the correlation function becomes the greatest, and to output a speech signal without significant loss of data.

Next, the speech time-scale modification method of the present invention will be described below with reference to drawings. It will be understood that the method can be performed by the speech time-scale modification apparatus mentioned above.

Hereinafter, the speech time-scale modification method applicable in a case where the condition that the time-scale modification ratio $\alpha$ is greater than or equal to 1.0 ($\alpha \geqq 1.0$) is satisfied will be described below.

This method is intended to produce a natural sounding speech signal with reduced occurrences of discontinuity in signal amplitude and phase and without any data loss, within the range of the time-scale modification ratio $\alpha \geqq 1.0$.

Herein, the time-scale modification ratio $\alpha$ is defined by the following equation.

Time-scale modification ratio $\alpha$=Reproduction time duration after time-scale modification/Reproduction time duration at normal rate.

Figure 3:
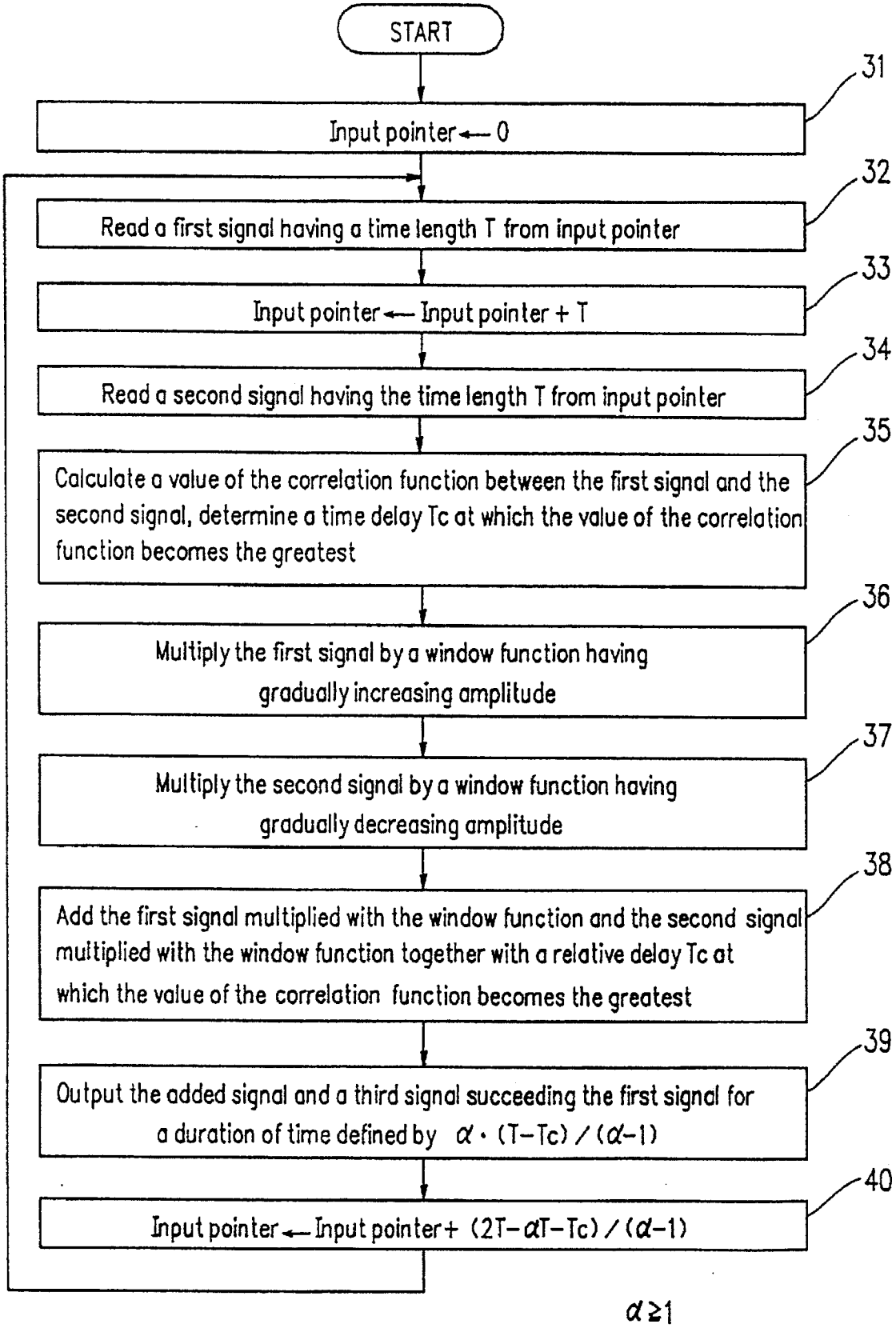
FIG. 3 is a flowchart illustrating a speech time-scale modification method according to the first embodiment of the invention.

FIG. 3 shows a flowchart illustrating the speech time-scale modification method. The operation of this speech time-scale modification method will be described below. First, at step 31, an input pointer is reset to 0. Next, at step 32, a first signal ($X_A$) having a time length T is read from a position indicated by the input pointer. At step 33, the input pointer is incremented by T. Then, at step 34, a second signal ($X_B$) having the time length T is read from a position indicated by the input pointer.

At step 35, a value of the correlation function between the first signal $X_A$ and the second signal $X_B$ is calculated, and a time delay $T_c$ at which the value of the correlation function becomes the greatest is determined.

Next, at step 36, based on the time delay $T_c$ at which the value of the correlation function becomes the greatest, the first signal $X_A$ is multiplied by a window function with gradually increasing amplitude. At step 37, based on the time delay $T_c$ at which the value of the correlation function becomes the greatest, the second signal $X_B$ is multiplied by a window function with gradually decreasing amplitude.

Then, at step 38, the first signal multiplied by the window function and the second signal multiplied by the window function are added together after shifting them with a relative delay $T_c$ at which the value of the correlation function becomes the greatest. Next, at step 39, the result of the addition at step 38 and a signal succeeding the first signal $X_A$, i.e. a third signal ($X_C$) starting from a position currently indicated by the input pointer, are output for a duration of time defined by $\alpha(T-T_c)/(\alpha-1)$. Then, at step 40, the input pointer is incremented by $(2T-\alpha T-T_c)/(\alpha-1)$. Finally, the process returns to step 32.

Figure 4:
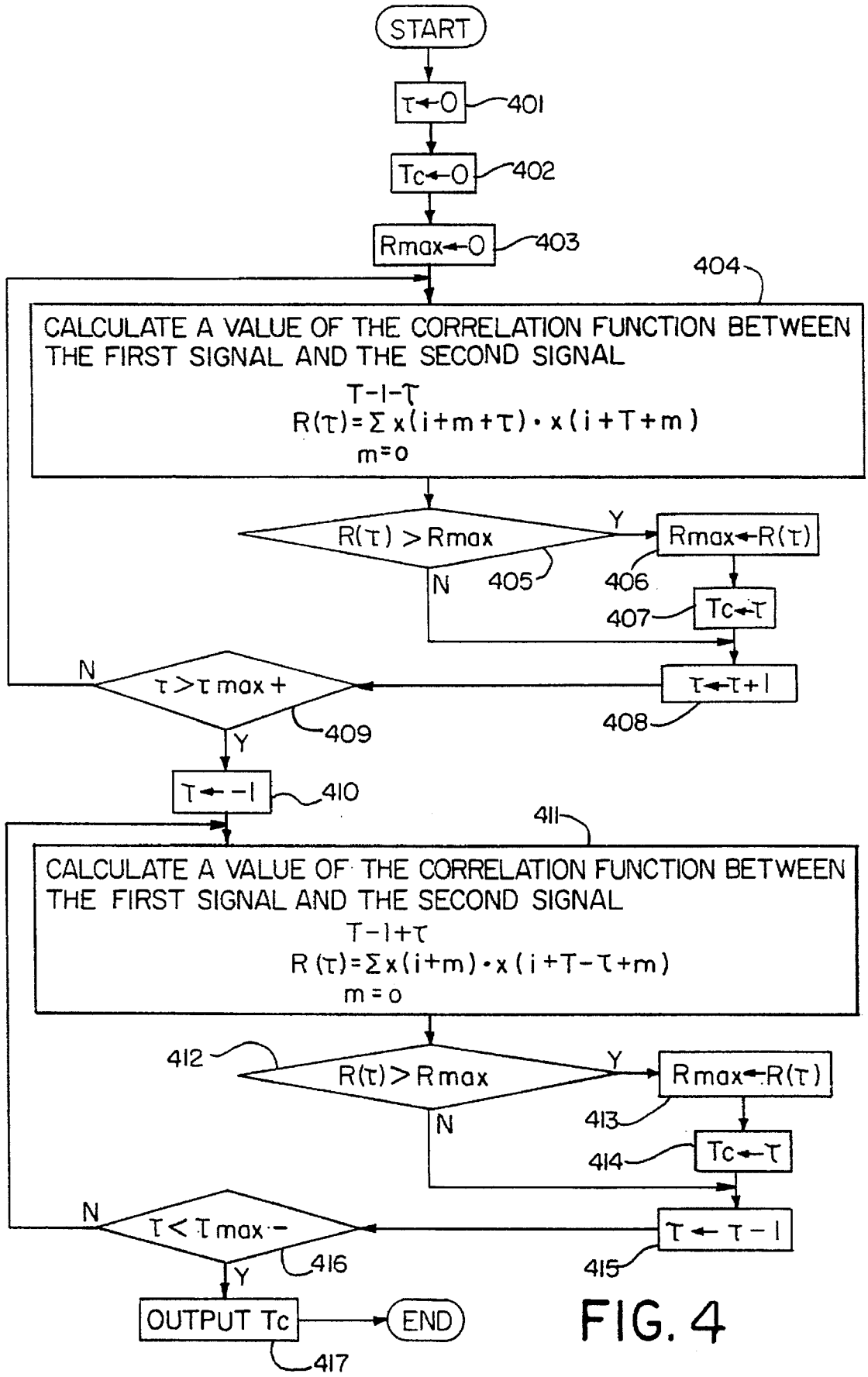
FIG. 4 is a flowchart illustrating how a search is made for a time delay $T_c$ at which the value of a correlation function becomes the greatest, in the speech time-scale modification method according to the first embodiment of the invention.

FIG. 4 shows the flowchart detailing the processing at step 35 in FIG. 3, at which the correlation function between the first signal $X_A$ and the second signal $X_B$ is calculated and a time delay $T_c$ at which the value of the correlation function becomes the greatest is determined.

The processing operation will be described below.

First, at step 401, step 402, and step 403, the time delay $\tau$, the time delay $T_c$ at which the value of the correlation function becomes the greatest, and the maximum value $R_{max}$ of the correlation function are respectively initialized to zero. Next, at step 404, the value of the correlation function $R(\tau)$ between the first signal $X_A$ and the second signal $X_B$, when the time delay $\tau$ is not negative, is calculated, in accordance with the following equation.

$$R(\tau)=\sum_{m=0}^{T-1-\tau} x(i+m+\tau)\cdot x(i+T+m)$$

where $$\tau_{max}+\geqq\tau\geqq 0$$

$R(\tau)$: Correlation function for time delay x(●): Input signal i: Start point of first signal $X_A$ T: Time length of first signal $X_A$ and second signal $X_B$ Then, at step 405, if the value of the correlation function $R(\tau)$ obtained at step 404 is not greater than the maximum value $R_{max}$ of the correlation function which is previously obtained, the process branches to step 408. Otherwise, the process proceeds to step 406, at which the maximum value $R_{max}$ of the correlation function is updated by $R(\tau)$, and at step 407, the time delay $T_c$ at which the value of the correlation function becomes the greatest is updated by $\tau$. Next, at step 408, the time delay $\tau$ is incremented by 1. At step 409, if the time delay t is not greater than a predetermined value $\tau_{max}+$, the process returns to step 404. The processing steps 404 to 408 are repeated until the time delay $\tau$ becomes equal to the predetermined value $\tau_{max}+$.

Then, at step 410, the time delay $\tau$ is initialized to −1. Next, at step 411, the value of the correlation function $R(\tau)$ between the first signal $X_A$ and the second signal $X_B$, when the time delay $\tau$ is negative, is calculated, in accordance with the following equation.

$$R(\tau)=\sum_{m=0}^{T-1+\tau} x(i+m)\cdot x(i+T-\tau+m)$$

where $$\tau_{max}-\leqq\tau<0$$

Then, at step 412, if the value of the correlation function $R(\tau)$ obtained at step 411 is not greater than the maximum value $R_{max}$ of the correlation function which is previously obtained, the process branches to step 415. Otherwise, the process proceeds to step 413, at which the maximum value $R_{max}$ of the correlation function is updated to be $R(\tau)$, and at step 414, the time delay $T_c$ at which the value of the correlation function becomes the greatest is updated to be $\tau$. Next, at step 415, the time delay $\tau$ is decremented by 1. At step 416, if the time delay $\tau$ is not smaller than a predetermined value $\tau_{max}-$, the process returns to step 411. The processing steps 411 to 415 are repeated until the time delay $\tau$ becomes equal to the predetermined value $\tau_{max}-$. Finally, at step 417, the time delay $T_c$ at which the value of the correlation function becomes the greatest is output.

Figure 5A:
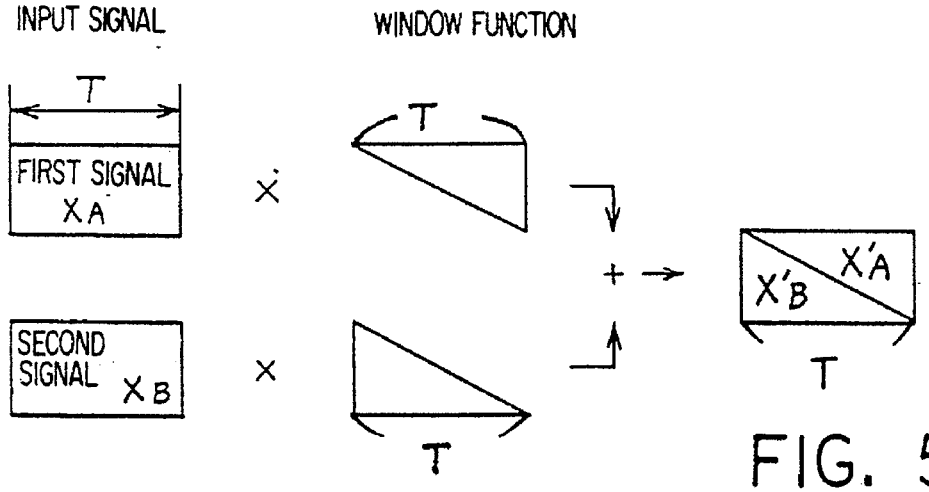
FIGS. 5A to 5C schematic diagrams illustrating how a first signal and a second signal are multiplied by their respective window functions and are added together in the speech time-scale modification method according to the first embodiment of the invention.
Figure 5B:
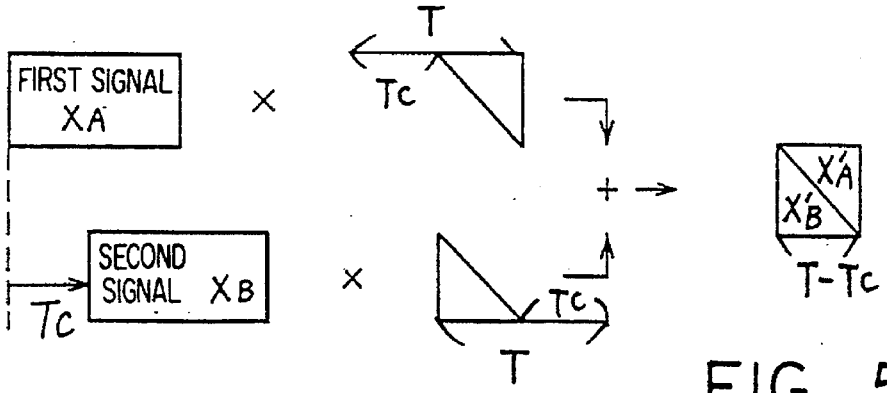
Figure 5C:
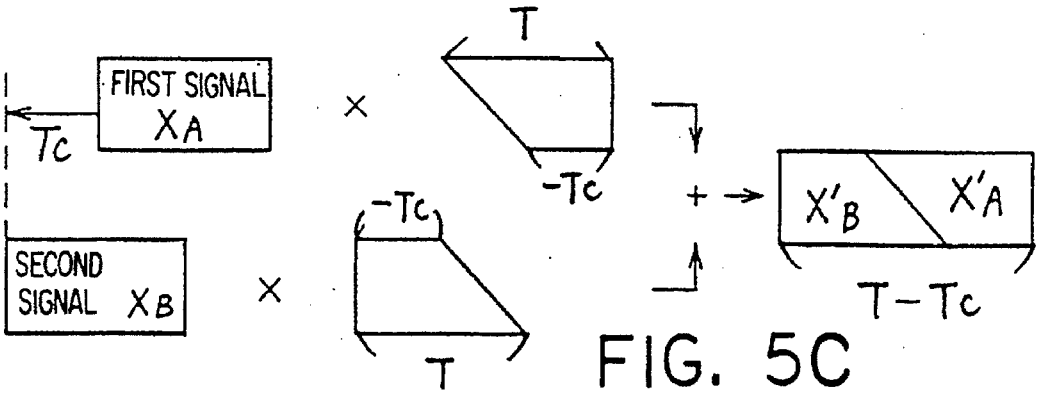

FIGS. 5A to 5C show schematic diagrams for describing the processing steps 36, 37, and 38 shown in FIG. 3.

FIG. 5A shows the case in which the time delay $T_c$ at which the value of the correlation function becomes the greatest is equal to 0 ($T_c$=0). FIG. 5B shows the case in which the time delay $T_c$ at which the value of the correlation function becomes the greatest is greater than 0 ($T_c$>0). FIG. 5C shows the case in which the time delay $T_c$ at which the value of the correlation function becomes the greatest is smaller than 0 ($T_c$<0). In any of these cases, the first signal is multiplied by a first window function whose amplitude gradually increases with time, the second signal is multiplied by a second window function whose amplitude gradually decreases with time, and the first signal multiplied by the first window function and the second signal multiplied by the second window function are added together after displacing them by the time delay $T_c$ at which the correlation function becomes the greatest.

Herein, the shape of the window function is varied in accordance with the time delay $T_c$ at which the correlation function becomes the greatest. Specifically, in the case of $T_c=0$, the first window function monotonically increases from 0 to 1 during the time length T, whereas the second window function monotonically decreases from 1 to 0 in a manner complementary to the first window function during the time length T. In the case of $T_c>0$, the first window function has a value of 0 during the time length $T_c$ and then monotonically increases from 0 to 1 during the time length $(T-T_c)$, whereas the second window function monotonically decreases from 1 to 0 in a manner complementary to the first window function during the time length $(T-T_c)$ and then has a value of 0 during the time length $T_c$. In the case of $T_c<0$, the first window function monotonically increases from 0 to 1 during the time length $(T-(-T_c))$ and then has a value of 1 during the time length $(-T_c)$, whereas the second window function has a value of 1 during the time length $(-T_c)$ and then monotonically decreases from 1 to 0 in a manner complementary to the first window function during the time length $(T-(-T_c))$. The length of the resulting sum is given as $T-T_c$.

Figure 6A:
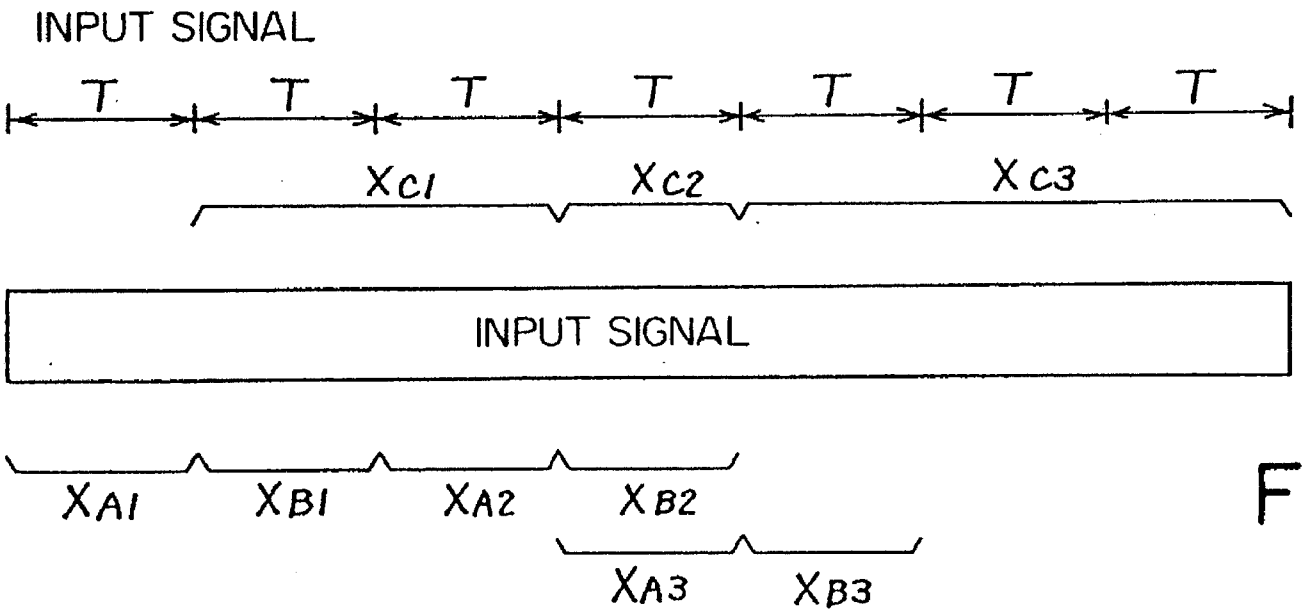
FIGS. 6A and 6B are schematic diagrams illustrating an input signal and an output signal in the speech time-scale modification method according to the first embodiment of the invention.
Figure 6B:
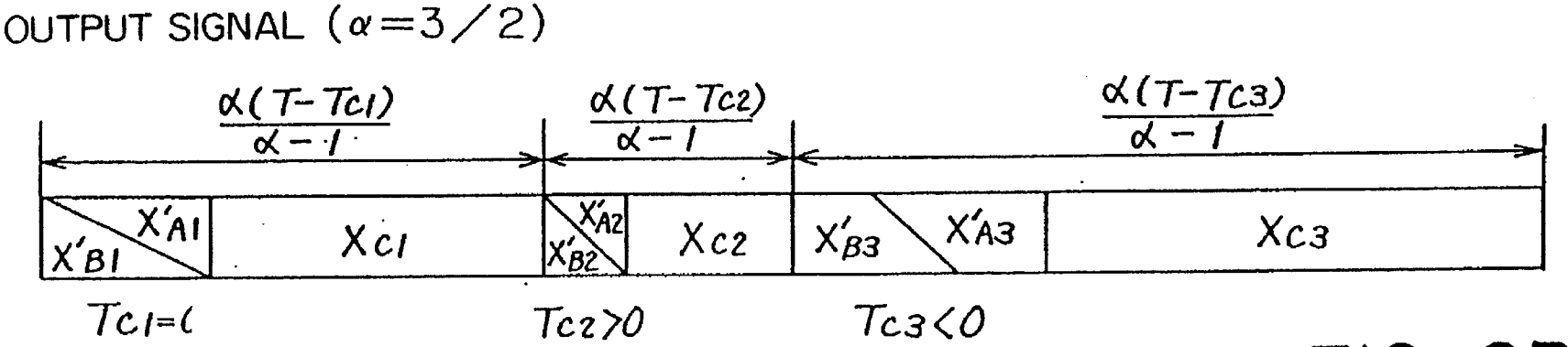

FIGS. 6A and 6B schematically show an example of an input signal and an output signal which are processed in accordance with the speech time-scale modification method mentioned above.

FIG. 6A shows an input signal, and FIG. 6B shows an output signal when the time-scale modification ratio is 3/2. It is assumed that the value of the correlation function between input signals $X_{A1}$ and $X_{B1}$ becomes the greatest when the time delay $T_{c1}=0$, the value of the correlation function between input signals $X_{A2}$ and $X_{B2}$ becomes the greatest when the time delay $T_{c2}>0$, and the value of the correlation function between input signals $X_{A3}$ and $X_{B3}$ becomes the greatest when the time delay $T_{c3}<0$.

The sum of the time length of a signal obtained by adding the first signal $X_{An}$ to the second signal $X_{Bn}$ and the time length of a third signal $X_{Cn}$ succeeding the first signal $X_{An}$ is defined by $\alpha(T-T_{cn})/(\alpha-1)$, for n=1, 2, 3. Thus, the sum of the time length of the added signal and the third signal is determined on the basis of the time-scale modification ratio $\alpha$, the time delay $T_{cn}$ at which the value of the correlation function becomes the greatest, and the time length T.

The ratio of the time length of the output signal to the time length of the input signal $(X_{C1}+X_{C2}+X_{C3})$ is equal to the preset time-scale modification ratio $\alpha$ (=3/2). Since $X_{Cn}$ is output directly, and all segments of the input signal are used, the output signal is entirely free from information loss.

As mentioned above, according to the speech time-scale modification method of the invention, the first signal $X_A$ is multiplied by the first window function having a gradually increasing amplitude and the second signal $X_B$ is multiplied by the second window function having a gradually decreasing amplitude. Then, the first signal $X_A$ multiplied by the first window function and the second signal $X_B$ multiplied by the second window function are added together. This makes it possible to reduce the discontinuity of the added signal in amplitude.

Further, the first signal $X_A$ multiplied by the first window function and the second signal $X_B$ multiplied by the second window function are added together with a relative delay $T_c$ at which the value of the correlation function becomes the greatest. This makes it possible to reduce the discontinuity in signal phase.

Furthermore, a signal obtained by adding the first signal $X_A$ multiplied by the first window function to the second signal $X_B$ multiplied by the second window function and a third signal $X_C$ succeeding the first signal $X_A$ are output for a duration of time determined on the basis of the time-scale modification ratio $\alpha$, the time delay $T_c$ at which the value of the correlation function becomes the greatest and the time length T. This makes it possible to output an expanded signal in a range of the time-scale modification ratio $\alpha \geqq 1.0$ and without significant loss of data.

Hereinafter, a speech time-scale modification method applicable in a case where the condition that the time-scale modification ratio $\alpha$ is smaller than or equal to 1.0 ($\alpha \geqq 1.0$) is satisfied will be described below.

This method is intended to produce a natural sounding speech signal with reduced occurrences of discontinuity in signal amplitude and phase and without any data loss, within the range of the time-scale modification ratio $\alpha \leqq 1.0$.

Figure 7:
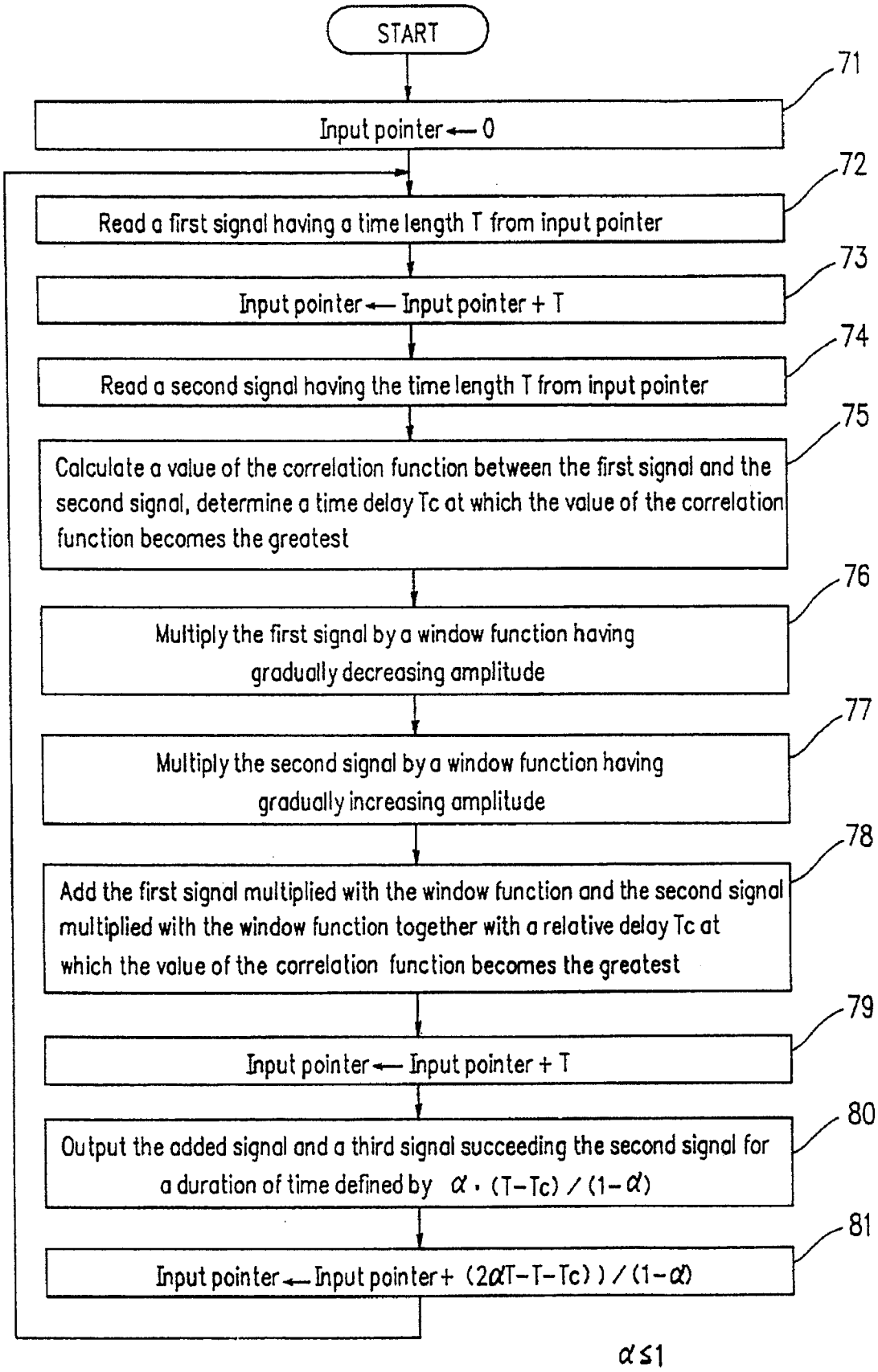
FIG. 7 is a flowchart illustrating another speech time-scale modification method according to the first embodiment of the invention.

FIG. 7 shows the flowchart illustrating the speech time-scale modification method according to the second embodiment of the invention.

The operation of this speech time-scale modification method will be described below.

First, at step 71, an input pointer is reset to 0. Next, at step 72, a first signal ($X_A$) having a time length T is read from a position indicated by the input pointer. At step 73, the input pointer is incremented by T. Then, at step 74, a second signal ($X_B$) having the time length T is read from a position indicated by the input pointer.

At step 7B, a value of the correlation function between the first signal $X_A$ and the second signal $X_B$ is calculated, and a time delay $T_c$ at which the value of the correlation function becomes the greatest is determined. Next, at step 76, based on the time delay $T_c$ at which the value of the correlation function becomes the greatest, the first signal $X_A$ is multiplied by a first window function having a gradually decreasing amplitude. At step 77, based on the time delay $T_c$ at which the value of the correlation function becomes the greatest, the second signal $X_B$ is multiplied by a second window function having a gradually increasing amplitude.

Then, at step 78, the first signal multiplied by the first window function and the second signal multiplied by the second window function are added together after shifting them to the position of the time delay $T_c$ at which the value of the correlation function becomes the greatest. At step 79, the input pointer is incremented by T. Next, at step 80, the result of the addition at step 78 and a signal succeeding the second signal $X_B$, i.e. a third signal ($X_C$) starting from a position currently indicated by the input pointer, are output for a duration of time defined by $\alpha(T-T_c)/(1-\alpha)$. Then, at step 81, the input pointer is incremented by $(2\alpha T-T-T_c)/(1-\alpha)$. Finally, the process returns to step 72.

The processing at step 75 in FIG. 7, at which the value of the correlation function between the first signal $X_A$ and the second signal $X_B$ is calculated and a time delay $T_c$ at which the value of the correlation function becomes the greatest is determined, is the same as illustrated in FIG. 4.

Figure 8A:
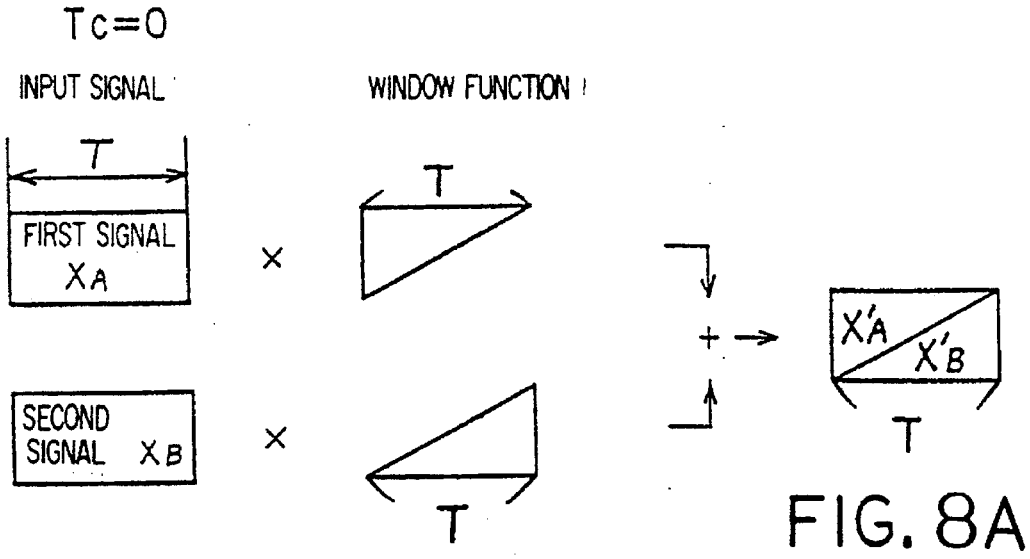
FIGS. 8A to 8C are schematic diagrams illustrating how a first signal and a second signal are multiplied by their respective window functions and are added together in the speech time-scale modification method according to the first embodiment of the invention.
Figure 8B:
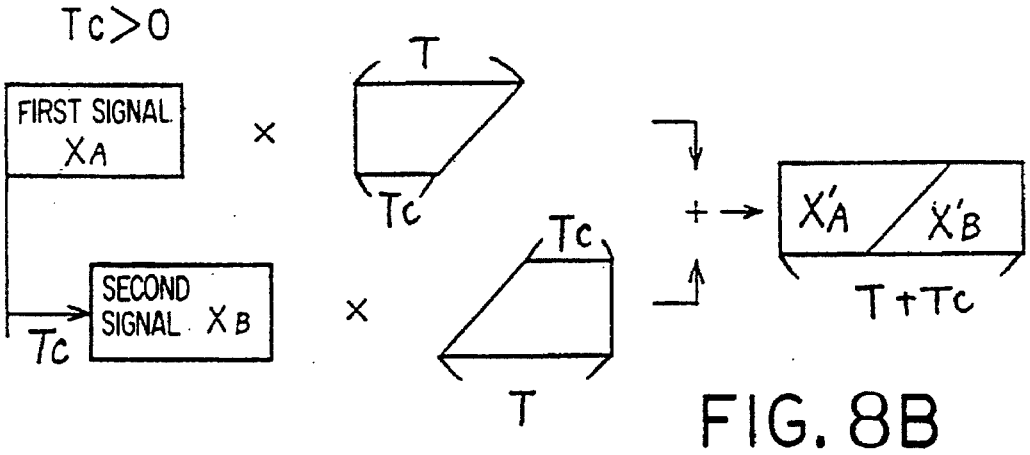
Figure 8C:
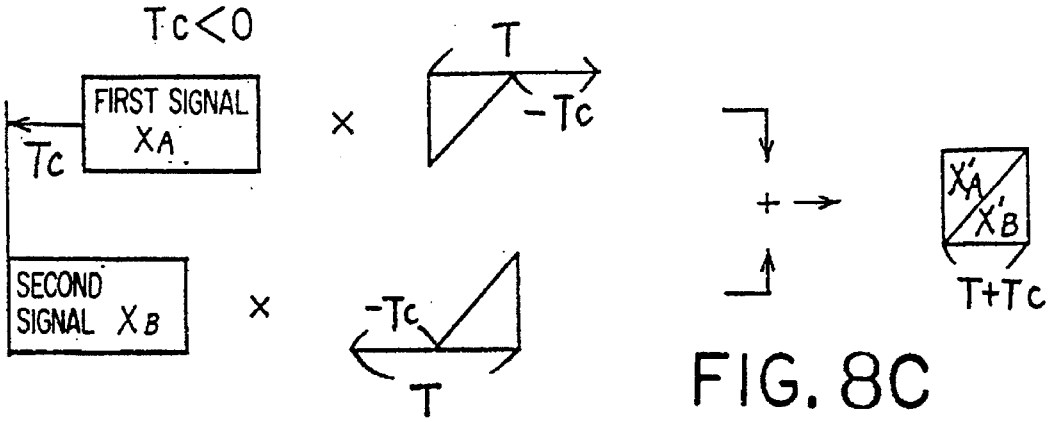

FIGS. 8A to 8C show schematic diagrams for describing the processing steps 76, 77, and 78 shown in FIG. 7.

FIG. 8A shows the case in which the time delay $T_c$ at which the value of the correlation function becomes the greatest is equal to 0 ($T_c=0$). FIG. 8B shows the case in which the time delay $T_c$ at which the value of the correlation function becomes the greatest is greater than 0 ($T_c>0$). FIG. 8C shows the case in which the time delay $T_c$ at which the value of the correlation function becomes the greatest is smaller than 0 ($T_c<0$). In any of these cases, the first signal is multiplied by the first window function whose amplitude gradually decreases with time, the second signal is multiplied by the second window function whose amplitude gradually increases with time, and the results are added together after displacing them by the time delay $T_c$ at which the correlation function becomes the greatest. Herein, the shape of the window function is varied in accordance with the time delay $T_c$ at which the correlation function becomes the greatest. The time length of the resulting sum is given as $T+T_c$.

Figure 9A:
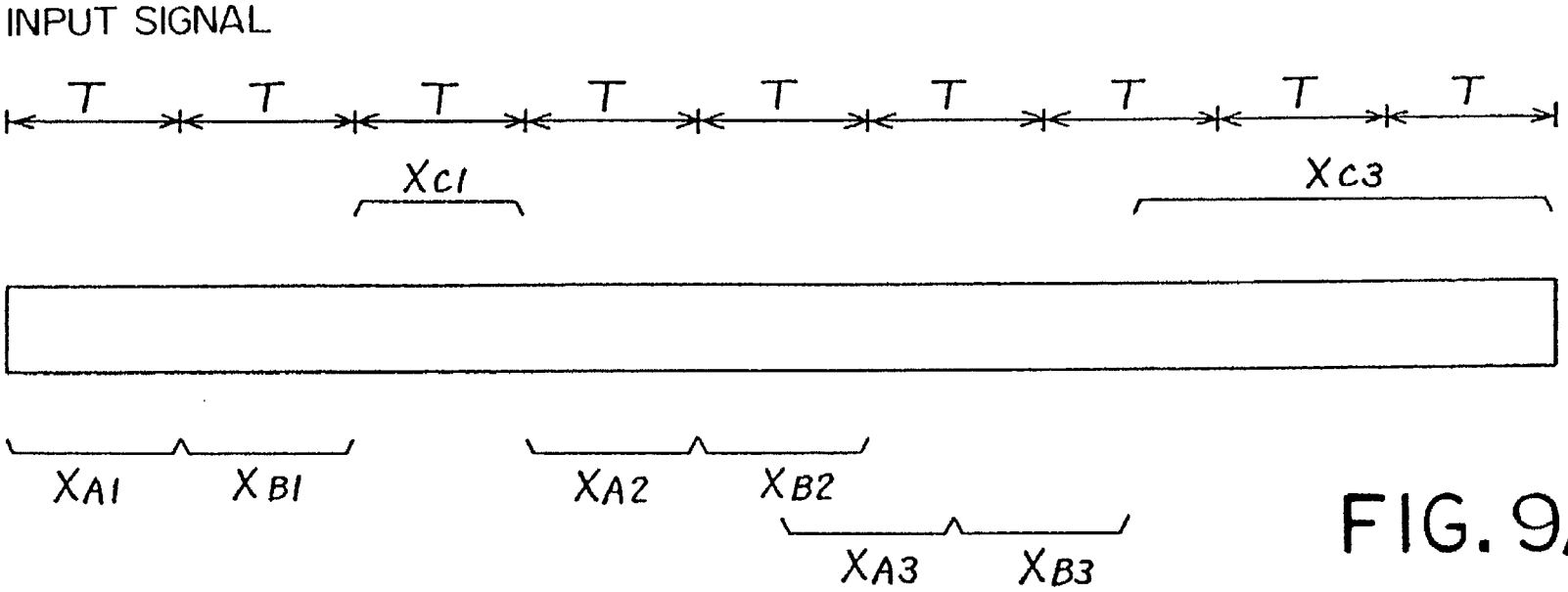
FIGS. 9A and 9B are schematic diagrams illustrating an input signal and an output signal in the speech time-scale modification method according to the first embodiment of the invention.
Figure 9B:
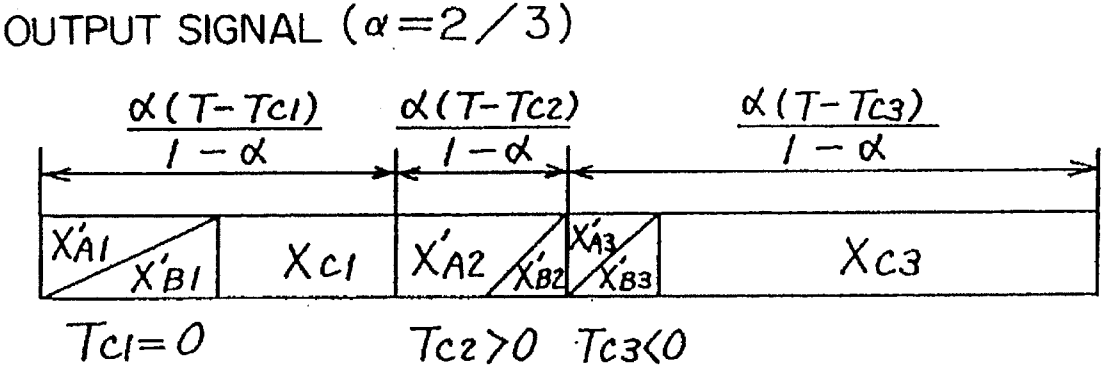

FIGS. 9A and 9B schematically show an example of an input signal and an output signal which are processed by the speech time-scale modification method mentioned above.

FIG. 9A shows an input signal, and FIG. 9B shows an output signal when the time-scale modification ratio $\alpha$ is 2/3. It is assumed that the value of the correlation function between input signals $X_{A1}$ and $X_{B1}$ becomes the greatest when the time delay $T_{c1}=0$, the value of the correlation function between input signals $X_{A2}$ and $X_{B2}$ becomes the greatest when the time delay $T_{c2}>0$, and the value of the correlation function between input signals $X_{A3}$ and $X_{B3}$ becomes the greatest when the time delay $T_{c3}<0$.

The sum of the time length of a signal obtained by adding the first signal $X_{An}$ to the second signal $X_{Bn}$ and the time length of a third signal $X_{Cn}$ succeeding the second signal $X_{Bn}$ is equal to a time length defined by $\alpha(T-T_{cn})/(1-\alpha)$. Thus, the sum of the time length of the added signal and the third signal is determined on the basis of the time-scale modification ratio $\alpha$, the time delay $T_{cn}$ at which the value of the correlation function becomes the greatest, and the time length T. The ratio of the time length of the output signal to the time length of the input signal is equal to the preset time-scale modification ratio $\alpha$ (=2/3). Since the input signal is used in all the segments, the first signal $X_{An}$, the second signal $X_{Bn}$, and the third signal $X_{Cn}$, there is no significant loss of information in the output signal.

As mentioned above, according to the speech time-scale modification method of the invention, the first signal $X_A$ is multiplied by the first window function having a gradually decreasing amplitude and the second signal $X_B$ is multiplied by the second window function having a gradually increasing amplitude. Then, the first signal $X_A$ multiplied by the first window function and the second signal $X_B$ multiplied by the second window function are added together. This makes it possible to reduce the discontinuity of the added signal in amplitude.

Further, the first signal $X_A$ multiplied by the first window function and the second signal $X_B$ multiplied by the second window function are added together with a relative delay $T_c$ at which the value of the correlation function becomes the greatest. This makes it possible to reduce the discontinuity in signal phase.

Furthermore, a signal obtained by adding the first signal $X_A$ multiplied by the first window function to the second signal $X_B$ multiplied by the second window function and a third signal $X_C$ succeeding the second signal $X_B$ are output for a duration of time determined on the basis of the time-scale modification ratio $\alpha$, the time delay $T_c$ at which the value of the correlation function becomes the greatest and the time length T. This makes it possible to output a compressed signal in a range of the time-scale modification ratio $\alpha \leqq 1.0$ and without significant loss of data.

A second embodiment of the speech time-scale modification apparatus and method of the invention will be described below with reference to drawings.

The present invention is intended to provide a speech time-scale modification apparatus and method that can be realized with simple hardware and that is capable of producing natural sounding speech with reduced occurrences of discontinuity in signal amplitude and phase and without significant loss of data.

Figure 10:
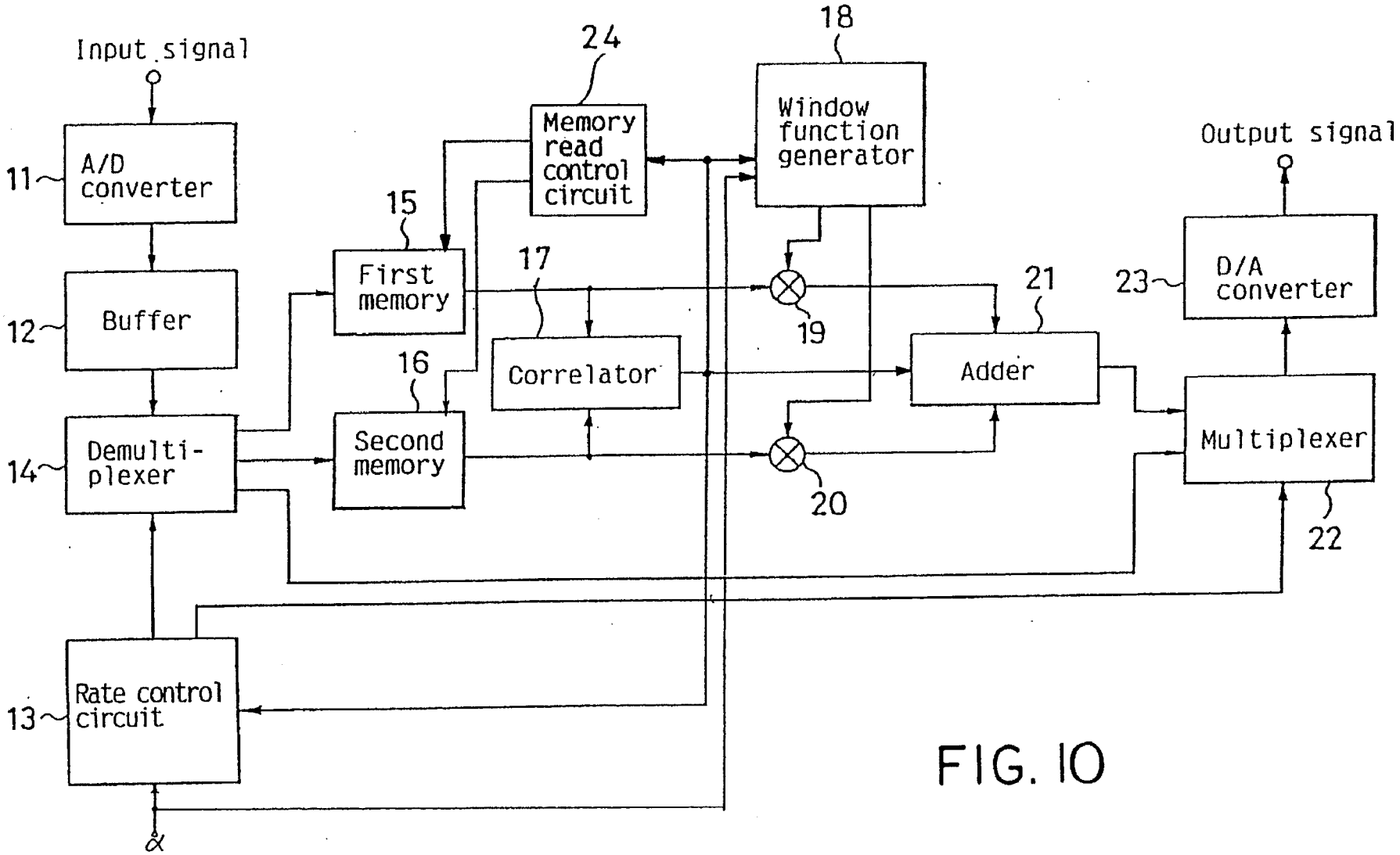
FIG. 10 is a block diagram showing the configuration of a speech time-scale modification apparatus according to the second embodiment of the invention.

FIG. 10 shows a configuration of a speech time-scale modification apparatus according to the second embodiment of the invention. As shown in FIG. 10, the speech time-scale modification apparatus includes an A/D converter 11, a buffer 12, a rate control circuit 13, a demultiplexer 14, a first memory 15 for storing an input signal having a time length (2T−1), a second memory 16 for storing an input signal having the time length (2T−1) and being delayed by time T from the input signal stored in the first memory 15, a correlator 17 for calculating a value of the correlation function between the contents of the first memory 15 and the contents of the second memory 16 and for determining a time delay $T_c$ at which the value of the correlation function becomes the greatest, a window function generator 18, a first multiplier 19, a second multiplier 20, an adder 21, a multiplexer 22, a D/A converter 23 and a memory read control circuit 24 for reading a signal from the contents of the first memory 15 in accordance with the output of the correlator 17 and for reading a signal from the contents of the second memory 16 in accordance with the output of the correlator 17.

The operation of the speech time-scale modification apparatus having the above configuration will be described below.

First, an input analog signal is converted by the A/D converter 11 into a digital signal, and then written into the buffer 12. The demultiplexer 14 passes the input signal stored in the buffer 12 to the first memory 15 for the duration of time length (2T−1), and then passes the input signal delaying by time T from the input signal stored in the first memory 15 to the second memory 16 for the duration of time length (2T−1).

The correlator 17 calculates a value of the correlation function by displacing timewise the contents of the first memory 15 from the contents of the second memory 16, and determines a time delay $T_c$ at which the value of the correlation function becomes the greatest. The determined time delay $T_c$ is supplied to the rate control circuit 13, the window function generator 18, the memory read control circuit 24, and the adder 21.

The memory read control circuit 24 reads a signal having a time length T or a time length $(T+|T_c|)$ from the first memory 15 and the second memory 16. Herein, the notation of $|\bullet|$ indicates an absolute value operation.

Based on the time delay $T_c$ from the correlator 17 and the time-scale modification ratio $\alpha$, the window function generator 18 generates a first window function whose amplitude gradually increases or decreases with time and whose time length is $T+|T_c|$ or T, and supplies the first window function to the first multiplier 19. The window function generator 18 also supplies a second window function, whose amplitude is complementary to the first window function and whose time length is T or $(T+|T_c|)$, to the second multiplier 20. The first multiplier 19 multiplies the output of the first memory 15 by the first window function from the window function generator 18, while the second multiplier 20 multiplies the output of the second memory 16 by the second window function from the window function generator 18.

Based on the time delay $T_c$ from the correlator 17, the adder 21 adds the output of the first multiplier 19 and the output of the second multiplier 20 together, with shifting the latter from the former by the time delay $T_c$ at which the value of the correlation function becomes the greatest and with overlapping one with the other for the time length T, and supplies the resulting sum to the multiplexer 22.

The rate control circuit 13 controls the demultiplexer 14 to pass the input signal stored in the buffer 12 to the multiplexer 22 so that the sum of the time length of the output of the adder 21 and the time length of the input signal succeeding the contents of the first or second memory 15 or 16 becomes equal to the time length determined on the basis of the time-scale modification ratio $\alpha$ (=output time duration/input time duration), the time delay $T_c$ from the correlator 17, and the time length T. Then, based on a control signal supplied from the rate control circuit 13, the multiplexer 22 switches between the output of the adder 21 and the output of the demultiplexer 14, and supplies the output to the D/A converter 23. The D/A converter 23 converts the digital signal supplied from the multiplexer 22 into an analog signal. Finally, based on the time-scale modification ratio $\alpha$, the time delay $T_c$ from the correlator 17, and the time length T, the rate control circuit 13 determines the start position of the input signal to be passed from the buffer 12 to the first memory 15 in the next processing operation.

In this embodiment, since the contents of the buffer 12 are repeated as the contents of the first memory 15 and the contents of the second memory 16, the contents of the buffer 12 may be passed from the demultiplexer 14 directly to the correlator 17, the first multiplier 19, the second multiplier 20, and the multiplexer 22, respectively. The first memory 15 and the second memory 16 can then be eliminated.

Figure 11:
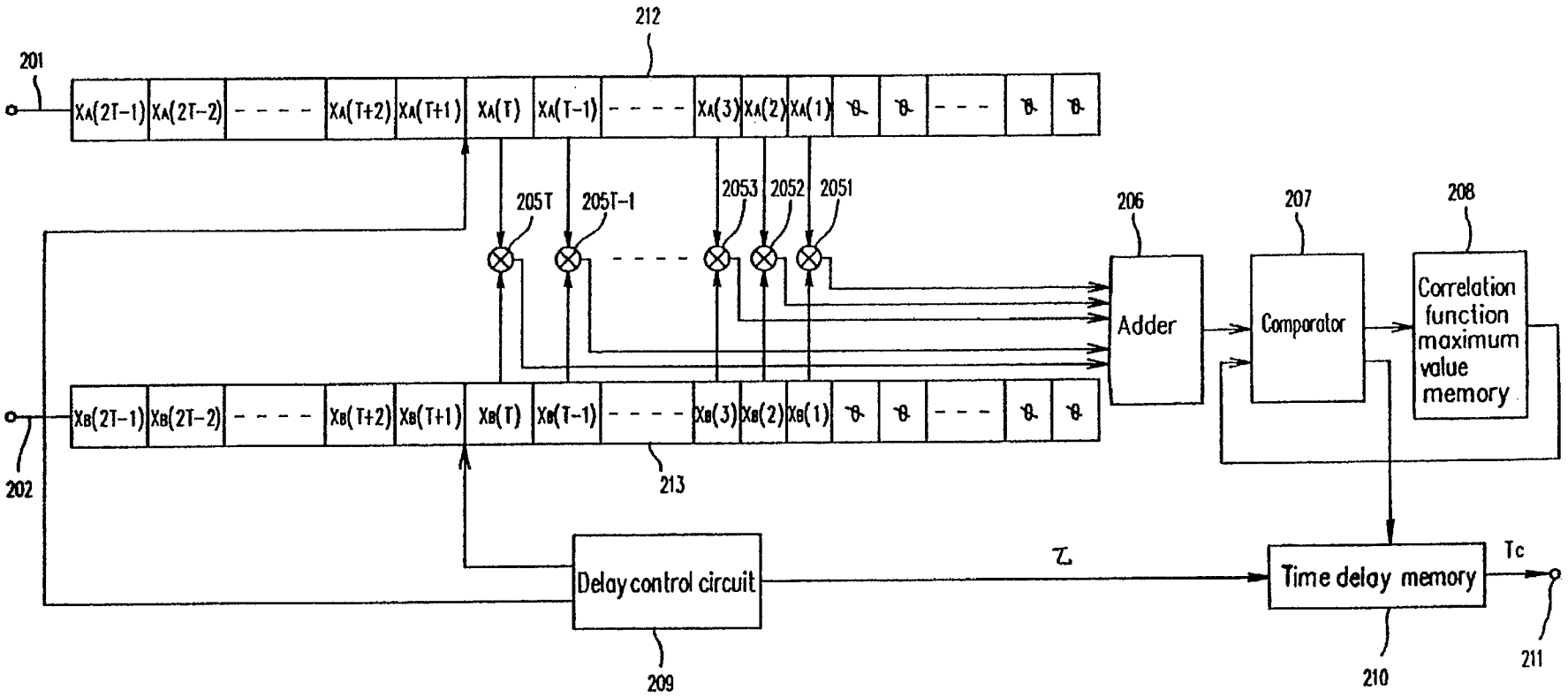
FIG. 11 is a block diagram showing a correlator in the speech time-scale modification apparatus according to the second embodiment of the invention.

FIG. 1 shows the configuration of the correlator 17 in the speech time-scale modification apparatus according to the second embodiment of the invention. As shown in FIG. 11, the correlator 17 includes an input terminal 201 for inputting the contents of the first memory 15, an input terminal 202 for inputting the contents of the second memory 16, and an output terminal 211. The correlator further includes a first shift register 212 having a time length (3T−2) for storing the contents of the first memory 15 for the time length (2T−1) and for introducing a delay by one sample, a second shift register 213 having the time length (3T−2) for storing the contents of the second memory 16 for the time length (2T−1) and for introducing a delay by one sample, multipliers 2051–205T, arranged in an array, for multiplying the contents of the first shift register 212 by the contents of the second shift register 213, an adder 206 for obtaining the total sum of the outputs of the multipliers 2051–205T, a comparator 207, a correlation function maximum value memory 208 for storing the maximum value of the output of the adder 206 supplied through the comparator 207, a delay controller 209 for controlling the time delay of the first shift register 212 and second shift register 213, a time delay memory 210 for storing the time delay of the first shift register 212 or second shift register 213 at which the correlation function becomes the greatest.

The operation of the thus configured correlator 17 of the speech time-scale modification apparatus will be described below.

In initial conditions, the contents of the first shift register 212, the contents of the second shift register 213, the content of the correlation function maximum value memory 208, the content of the delay controller 209 and the content of the time delay memory 210 are cleared to zero.

Then, the contents of the first memory 15 is applied at the input terminal 201 and transferred to the leftmost position of the first shift register 212 for the duration of time length (2T−1), while the contents of the second memory 202 is applied at the input terminal 202 and transferred to the leftmost position of the second shift register 213 for the duration of time length (2T−1). Next, the multipliers 2051–205T multiply the contents of the first shift register 212 by the contents of the second shift register 213. The adder 206 obtains the total sum of the outputs of the multipliers 2051–205T, and outputs the sum as a value of the correlation function when the time delay is $\tau$.

The comparator 207 then compares the output of the adder 206 with the content of the correlation function maximum value memory 208. If the comparator 207 judges that the output of the adder 206 is greater than the value stored in the correlation function maximum value memory 208, the comparator 207 supplies the output of the adder 206 to the correlation function maximum value memory 208, and at the same time, controls the time delay memory 210 so as to store the output $\tau$ of the delay controller 209 as a time delay $T_c$ at which the value of the correlation function becomes the greatest.

When the time delay $\tau$ is positive, the delay controller 209 controls the first and second shift register 212 and 213 so that the contents of the second memory 16 are fixed at the leftmost position of the second shift register 213, so that the contents of the first shift register 212 are delayed to the right direction by one sample at a time, and so that the time delay $\tau$, initialized to 0, is incremented by 1 at a time.

When the time delay $\tau$ is negative, the delay controller 209 controls the first and second shift registers 212 and 213 so that the contents of the first memory 15 are fixed at the leftmost position of the first shift register 212, so that the contents of the second shift register 213 are delayed to the right direction by one sample at a time, and so that the time delay $\tau$, initialized to 0, is decremented by 1 at a time. Then, the process returns to the step where the multipliers, 2051–205T, multiply the contents of the first shift register 212 by the contents of the second shift register 213. This process is repeated as long as the time delay $\tau$ stays within the range of $-T+1 \leqq \tau \leqq +T-1$. When these repetitions are completed, the contents stored in the time delay memory 210 is output from the output terminal 211 as a time delay $T_c$ at which the value of the correlation function between the contents of the first memory 15 and the contents of the second memory 16 becomes the greatest.

In the above embodiment, the search range of the correlation function is set at $-T+1 \leqq \tau \leqq +T-1$, but this may be set at $-T+k \leqq \tau \leqq +T-j$ (where $T>k>1$, $T>j>1$). In the latter case, not only the time lengths of the first shift register 212 and second shift register 213 can be shortened, but the number of times of correlation function calculations can also be reduced since the number of repetitions of multiplication and addition operations is reduced.

Furthermore, in the above embodiment, since the contents to be stored in the first shift register 212 are the same as the contents stored in the first memory 15, and the contents to be stored in the second shift register 213 are the same as the contents stored in the second memory 16, it may be so configured that the contents of the first memory 15 and second memory 16 are sequentially input to the multipliers 2051–205T each time the time delay $\tau$ is changed. In this case, the first shift register 212 and the second shift register 213 can be eliminated.

As mentioned above, according to the speech time-scale modification apparatus of the second embodiment of the invention, the first multiplier 19 and the second multiplier 20 multiply the contents of the first memory 15 and the contents of the second memory 16 with window functions whose amplitude gradually increase or decrease output from the window function generator 18. The adder 21 adds the outputs of the first multiplier 19 and the second multiplier 20 together. This makes it possible to output a natural sounding speech signal with reduced occurrences of discontinuity in signal amplitude and without significant loss of data.

Further, the correlator 17 calculates the correlation function between the contents of the first memory 15 and the contents of the second memory 16. The adder 21 adds the outputs of the first multiplier 19 and the second multiplier 20 together with a relative delay $T_c$ at which the value of the correlation function becomes the greatest. This makes it possible to output a speech signal with high quality and with reduced occurrences of discontinuity in signal phase.

Furthermore, the rate control circuit 13 controls the demultiplexer 14 and the multiplexer 22 so that the sum of the time length of the output of the adder 21, the time length of input signal succeeding the contents of the first memory 15 or the contents of the second memory 16 from the buffer 12 is equal to a time length determined on the basis of the time-scale modification ratio α, the time delay $T_c$ from the correlator 17 and the time length T. This makes it possible to easily change the time scale modification ratio, to absorb the displacement of the time scale modification ratio which is caused by adding the outputs of the first multiplier 19 and the second multiplier 20 together with a relative delay $T_c$ at which the value of the correlation function becomes the greatest, and to output a speech signal without significant loss of data.

Furthermore, the adder 21 adds the contents of the first memory 1B which have a time length T or $T+|T_c|$ and are multiplied by the window function by the first multiplier 19 to the contents of the second memory 16 which have a time length $T+|T_c|$ or T and are multiplied by the window function by the second multiplier 20 with a state of overlapping them for the time length T. Therefore, the overlap time length is kept constant, which contributes to reducing the possibility of amplitude discontinuity which tends to occur when the overlap time length becomes short.

Furthermore, the correlator 17 calculates the value of the correlation function by overlapping the contents of the first memory 15 with the contents of the second memory 16 for the time length T regardless of the time delay τ. Therefore, the time length during which the correlation function is calculated does not become shorter with increasing departure of the time delay τ from 0, so that the correlation function can be calculated with good accuracy.

Hereinafter, the speech time-scale modification method of the second embodiment of the present invention will be described below with reference to the drawings. It will be understood that the method can be performed by the speech time-scale modification apparatus mentioned above.

The speech time-scale modification method can be applied when the time-scale modification ratio α is within the range defined by the following expression.

$$(T+\tau_{max}+)/(2T) \leqq \alpha \leqq 1.0$$

Figure 12:
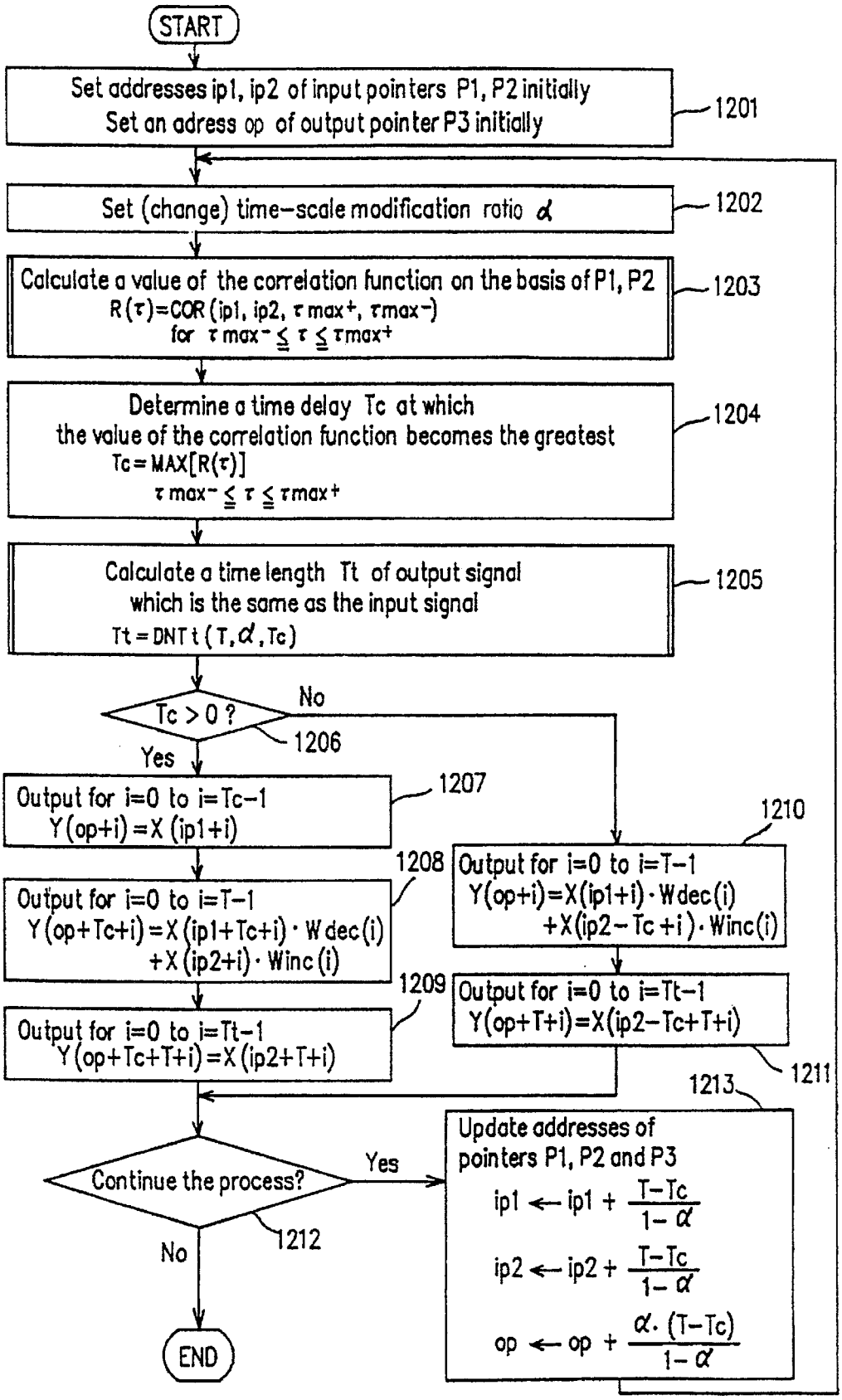
FIG. 12 is a flowchart illustrating a speech time-scale modification method according to the second embodiment of the invention.

FIG. 12 shows the flowchart illustrating the speech time-scale modification method. The operation will be described below.

In the following description, it is assumed that the input signal is sampled in the form of discrete time data x(n) and that the time is expressed in terms of the sampling time. In the processing hereinafter described, data are designated by input data pointers P1, P2 and an output data pointer P3.

First, at step 1201, an address ip1 indicated by the input data pointer P1 is set to a starting address of an input signal to be reproduced. At the same time, an address ip2 indicated by the pointer P2 is set to an address away from the address indicated by the input data pointer P1 by T. Furthermore, an address op indicated by the output data pointer is set to an initial value. At step 1202, the time-scale modification ratio α is set. The ratio α should satisfy the condition set by the above expression.

It is assumed that a signal A has a time length T from the pointer P1 and a signal B has the time length T from the pointer P2.

At step 1203, a value of the correlation function between the signal A and a signal which has the time length T and delays from the signal B by a time delay (−τ) for $-T<\tau<0$ is calculated, and a value of the correlation function between the signal B and a signal which has the time length T and delays from the signal A by the time delay τ for $0 \leqq \tau < T$ is calculated.

Figure 13:
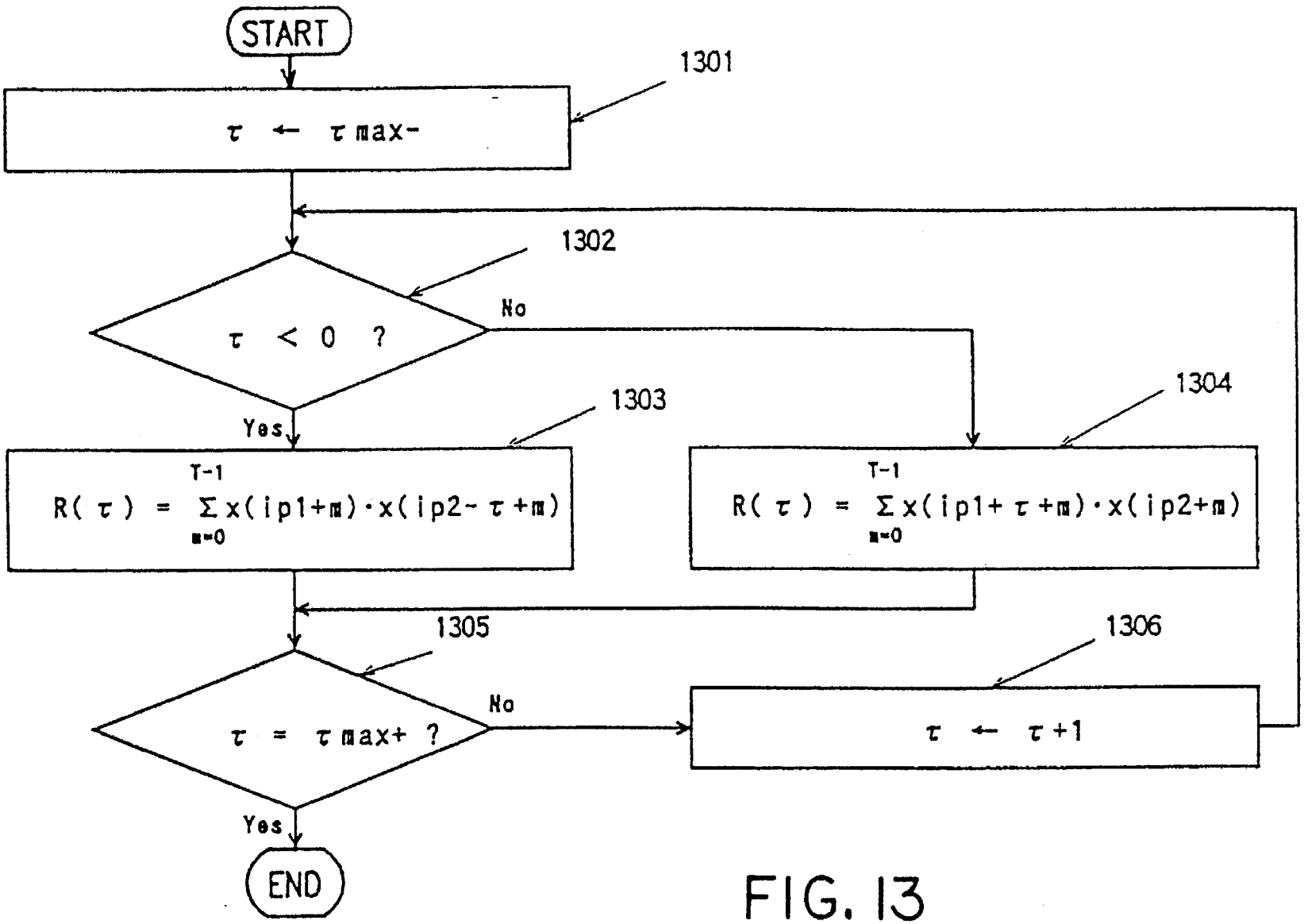
FIG. 13 is a flowchart illustrating a procedure for correlation function calculation in the speech time-scale modification method according to the second embodiment of the invention.

At step 1204, a time delay $T_c$ at which the value of the correlation function becomes the greatest is determined. For the calculation of the correlation function COR, the range of the input signal used varies according to whether the sign of the value of τ is positive or negative, as shown in FIG. 13. More specifically, when the time delay τ is positive, the signal B is fixed as the reference, and a signal A'=x(ip1+τ+m) (where $0 \leqq m \leqq T-1$) delaying by time τ from the signal A is used, as shown in step 1304 of FIG. 13. Conversely, when the time delay τ is negative, the signal A is fixed as the reference, and a signal B'=x(ip2−τ+m) (where $0 \leqq m \leqq T-1$) delaying by time −τ from the signal B is used, as shown in step 1303 of FIG. 13. Further, a positive maximum value $\tau_{max}+$ of the time delay τ and a negative maximum value $\tau_{max}-$ of the time delay τ are predetermined, to limit the range of the time delay τ based on which the correlation function is to be calculated. The time delay $T_c$ at which the value of the correlation function becomes the greatest can thus be obtained.

Figure 14:
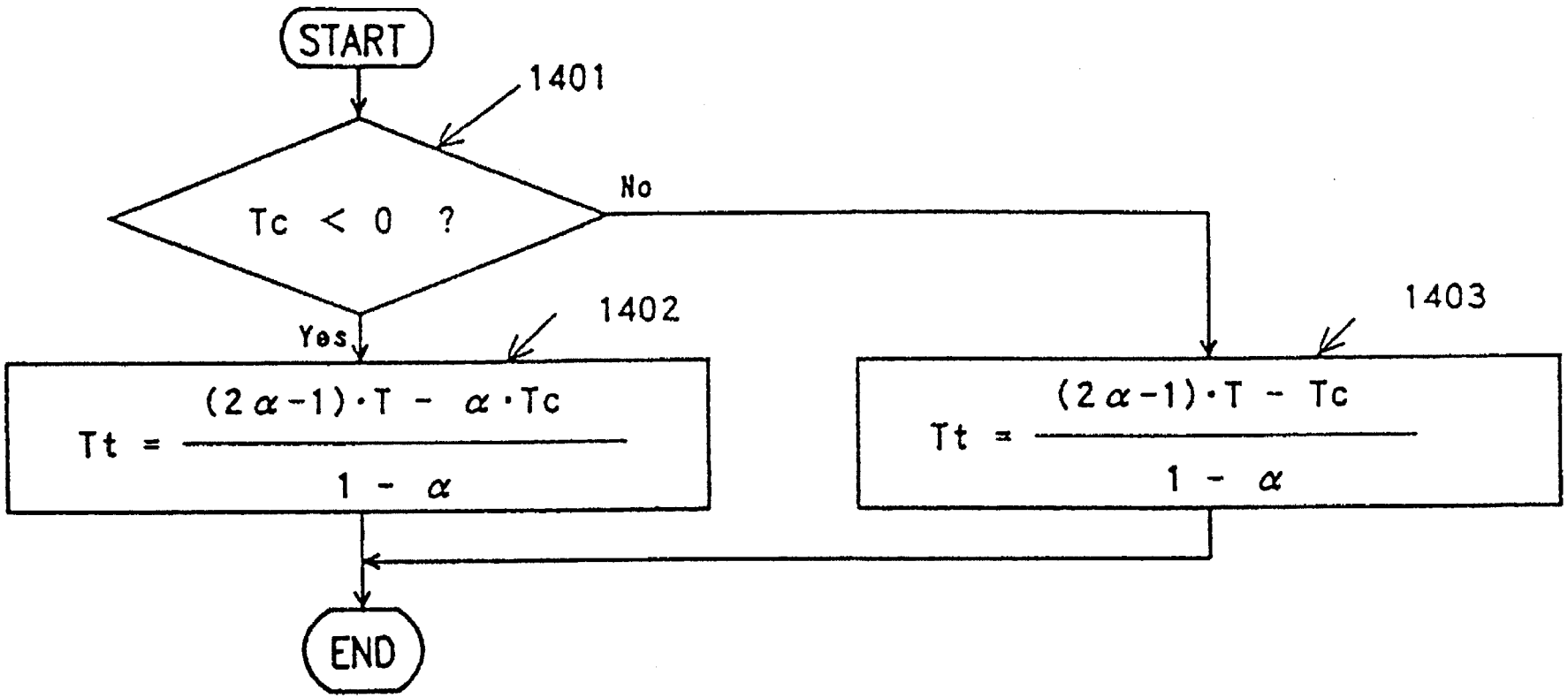
FIG. 14 is a flowchart illustrating a procedure for calculating a time length $T_r$ in the speech time-scale modification method according to the second embodiment of the invention.

At step 1205, a time length $T_t$, during which the input signal is outputted directly, is calculated as shown in FIG. 14. For the calculation of the time length $T_t$ defining the segment of the input signal to be outputted directly, the calculation formula is different according to the sign of the time delay $T_c$. More specifically, when the time delay $T_c$ at which the value of the correlation function becomes the greatest is positive, the time length $T_t$ during which the input signal is to be outputed directly is obtained as shown in step 1403 of FIG. 14. On the other hand, when the time delay $T_c$ at which the value of the correlation function becomes the greatest is negative, the time length $T_t$ during which the input signal is to be output directly is obtained as shown in step 1402 of FIG. 14. Further, if the value of the time delay $T_c$ is positive, an output signal is obtained by going through steps 1207, 1208, and 1209. If not, an output signal is obtained by going through steps 1210 and 1211. Herein, Wdec(i) shown in steps 1208 and 1210 is a window function wherein the size of the window is 1 when i is 0, the size decreasing monotonically in linear fashion as i increases and reaching 0 when i is T−1. On the other hand, Winc(i) shown in steps 1208 and 1210 is a window function wherein the size of the window is 0 when i is 0, the size increasing monotonically in linear fashion as i increases and reaching 1 when i is T−1.

Figure 15:
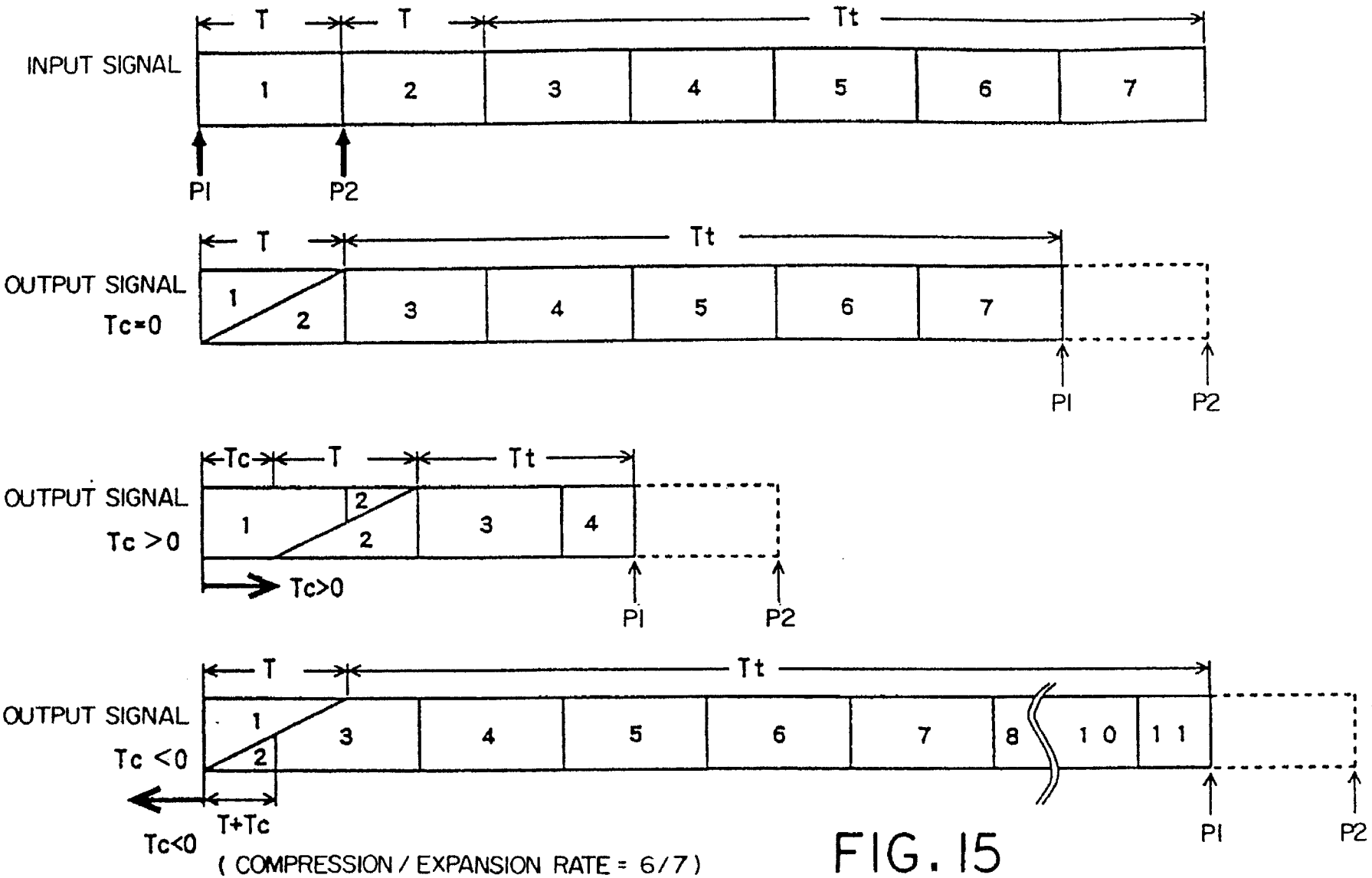
FIG. 15 is a schematic diagram showing an input signal and an output signal in the speech time-scale modification method according to the second embodiment of the invention.

FIG. 15 shows how the output signal is obtained in cases where the value of the time delay $T_c$ at which the value of the correlation function becomes the greatest is zero, where $T_c$ is positive, and where $T_c$ is negative. It can be seen that when the time delay $T_c$ at which the value of the correlation function becomes the greatest is positive, $T_t$ is shorter than when $T_c$ is zero. Conversely, when $T_c$ is negative, $T_t$ is longer. This is because the length of $T_t$ is adjusted according to the displacement of $T_c$ in order to prevent the occurrence of a departure from the preset time-scale modification ratio. When the processing is to be continued, the addresses indicated by the input data pointers and output data pointer are updated as shown in step 1213, and then, the process starting with step 1202 is repeated.

According to the speech time-scale modification method mentioned above, a method of compressing the reproduction time for output (a method of increasing the reproduction speed without changing the pitch of speech) can be realized which has the features hereinafter described. At step 1203, a value of the correlation function is calculated using the pointer P1 or P2 as the reference, and at step 1208 or 1210, the signal A or signal A' and the signal B' or signal B are weighted with the time delay $T_c$ at which the value of the correlation function becomes the greatest, and then added together. This prevents a significant phase mismatch from occurring between the segments where the signals are connected together.

At step 1208 or 1210, prior to the addition, the signal A or A' is multiplied by the window function Wdec(i) whose amplitude monotonically deceases with time, and the signal B' or signal B is multiplied by the window function Winc(i) whose amplitude monotonically increases with time. This ensures a good amplitude continuity between the segments where the signals are connected together. With the above operations, reproduction of smooth, natural, and clear sound, without significant loss of information and with reduced echo effects, can be obtained, which was not possible with the prior art.

It should also be noted that at step 1205, the time length $T_t$ during which the input signal succeeding the signal B' or signal B is directly output after the weight addition is calculated on the basis of the time delay $T_c$ at which the value of the correlation function becomes the greatest, so that a change in $T_c$ does not cause a displacement of the time-scale modification ratio $\alpha$ of the actual output signal.

Furthermore, the length of the segment along which the addition with weights is performed at step 1208 or 1210 is fixed to a constant time length T which is independent of the input signal or the time delay $T_c$ at which the value of the correction function becomes the greatest, so that there is no possibility of the cross-fade length being reduced because of the value of $T_c$. The resulting reproduction sound is thus characterized by smooth low-frequency components contained in the signals connected together.

Another speech time-scale modification method of the second embodiment of present invention will be described below with reference to drawings. It will be understood that the method can be performed by the speech time-scale modification apparatus mentioned above.

The speech time-scale modification method can be applied when the time-scale modification ratio $\alpha$ is within the range defined by the following expression.

$$1.0 \leqq \alpha \leqq T/\tau_{max}+$$

Figure 16:
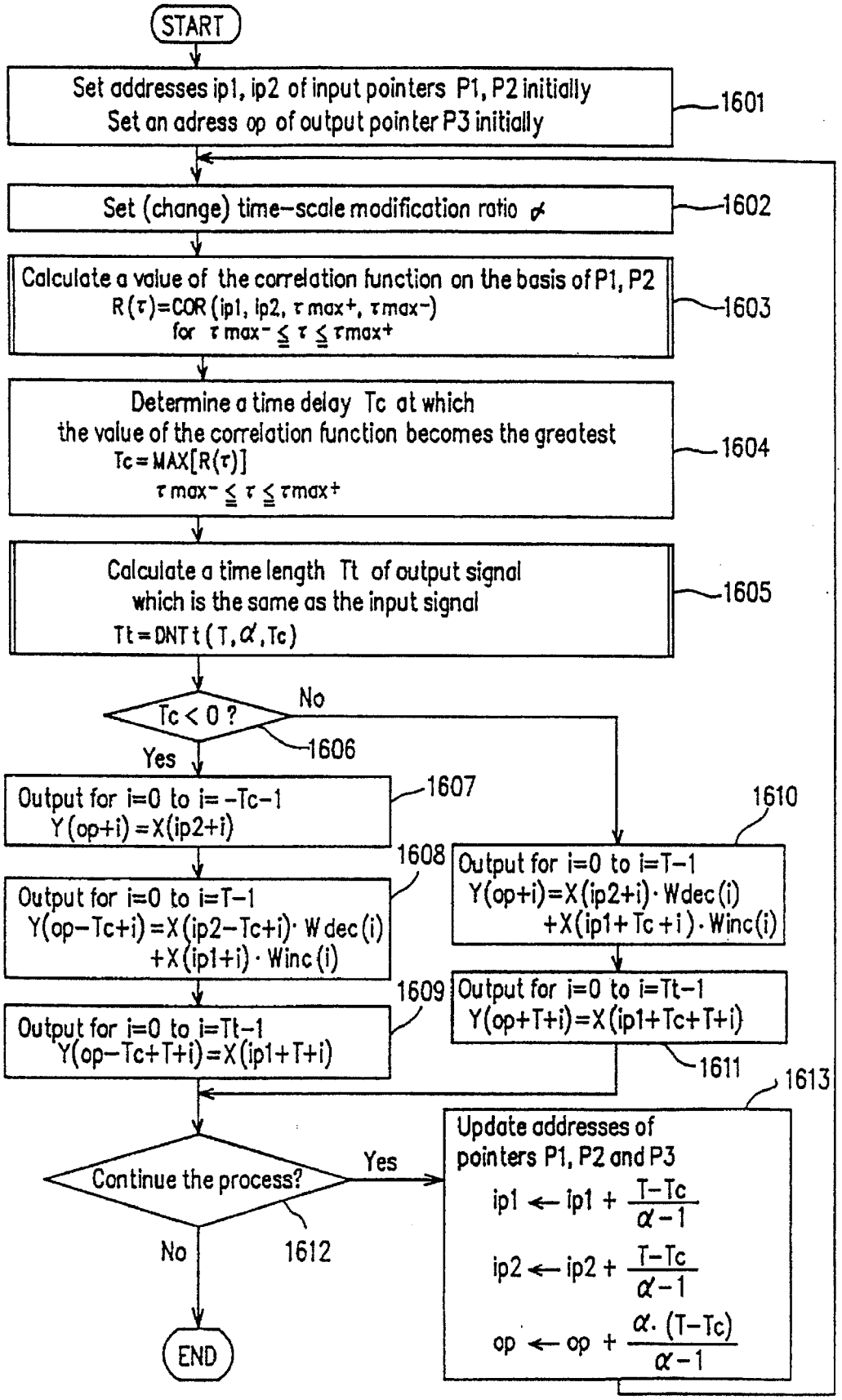
FIG. 16 is a flowchart illustrating another speech time-scale modification method according to the second embodiment of the invention.

FIG. 16 shows the flowchart illustrating the speech time-scale modification method. The operation will be described below.

In the following description, it is assumed that the input signal is sampled in the form of discrete time data x(n) and that the time is expressed in terms of the sampling time. Further, data are designated using input data pointers P1, P2 and an output data pointer P3.

First, at step 1601, an address ip1 indicated by the input data pointer P1 is set to a starting address of an input signal to be reproduced. At the same time, an address ip2 indicated by the pointer P2 is set to an address away from the address indicated by the input data pointer P1 by T. Furthermore, an address op indicated by the output data pointer is set to an initial value. At step 1602, the time-scale modification ratio $\alpha$ is set. The ratio $\alpha$ should satisfy the condition set by the above expression.

It is assumed that a signal A has a time length T from the pointer P1 and a signal B has the time length T from the pointer P2.

At step 1603, a value of the correlation function between the signal A and a signal which has the time length T and delays from the signal B by a time delay $(-\tau)$ for $-T<\tau<0$ is calculated, and a value of the correlation function between the signal B and a signal which has the time length T and delays from the signal A by the time delay $\tau$ for $0 \leqq \tau < T$ is calculated.

At step 1604, a time delay $T_c$ at which the value of the correlation function becomes the greatest is determined.

Referring back to FIG. 13, the value of the correlation function COR is calculated in the following manner. When the time delay $\tau$ is positive, the signal B is fixed as the reference, and a signal $A'=x(ip1+\tau+m)$ (where $0 \leqq m \leqq T-1$) delaying by time $\tau$ from the signal A is used, as shown in step 1304. Conversely, when the time delay $\tau$ is negative, the signal A is fixed as the reference, and a signal $B'=x(ip2-\tau+m)$ (where $0 \leqq m \leqq T-1$) delaying by time $-\tau$ from the signal B is used, as shown in step 1303. Further, a maximum value $\tau_{max}+$ of the time delay $\tau$ and a minimum value $\tau_{max}-$ of the time delay $\tau$ are predetermined, to limit the range of the time delay $\tau$ based on which the correlation function is to be calculated. The time delay $T_c$ at which the value of the correlation function becomes the greatest can thus be obtained.

Figure 17:
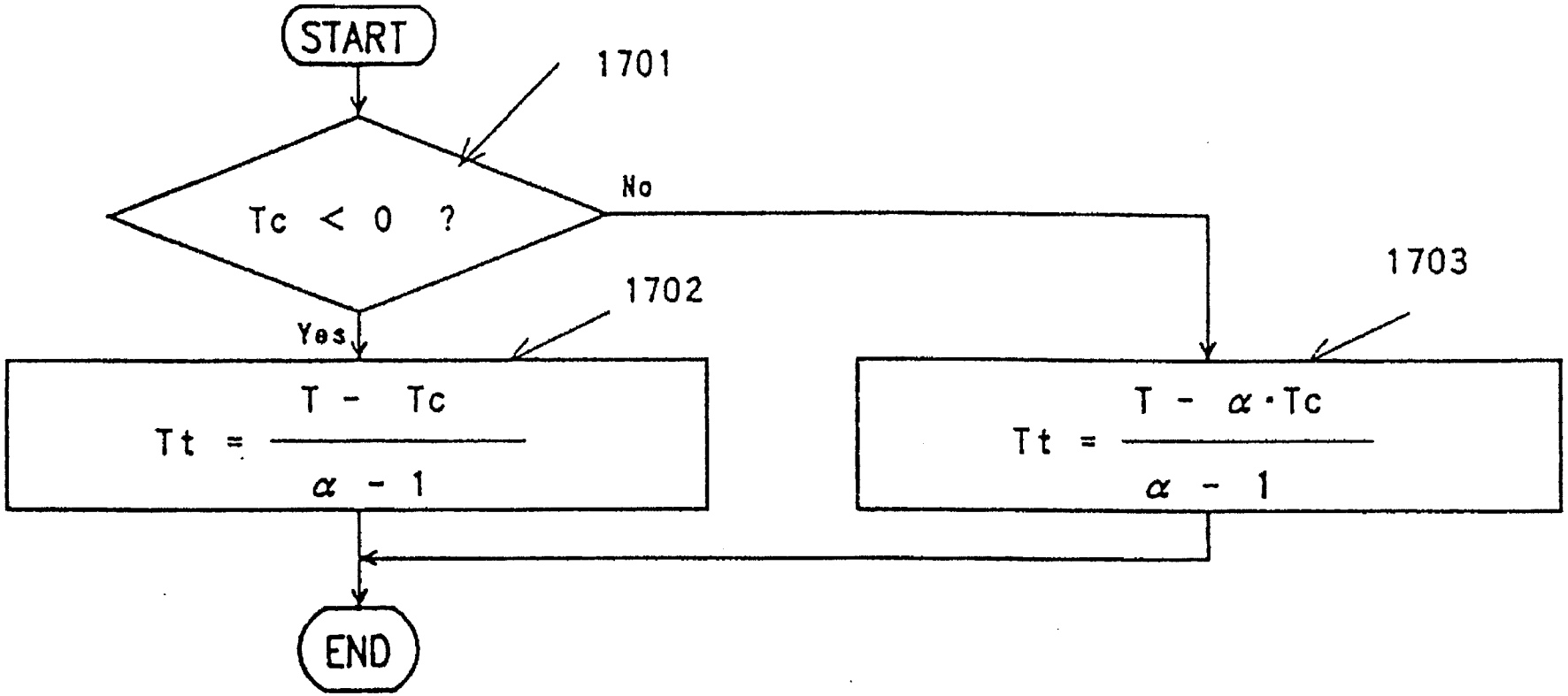
FIG. 17 is a flowchart illustrating a procedure for calculating a time length $T_r$ in the speech time-scale modification method according to the second embodiment of the invention.

At step 1605, a time length $T_t$, during which the input signal is output directly, is calculated as shown in FIG. 17. For the calculation of the time length $T_t$ defining the segment of the input signal to be output directly, the calculation formula is different according to the sign of $T_c$. More specifically, when the time delay $T_c$ at which the value of the correlation function becomes the greatest is positive, the time length $T_t$ during which the input signal is to be output directly is obtained as shown in step 1703. On the other hand, when the time delay $T_c$ at which the correlation function becomes the greatest is negative, the time length $T_t$ during which the input signal is to be output directly is obtained as shown in step 1702.

Further, if the value of $T_c$ is negative, an output signal is obtained by going through steps 1607, 1608, and 1609. If not, an output signal is obtained by going through steps 1610 and 1611. Herein, Wdec(i) shown in steps 1608 and 1610 is a window function wherein the size of the window is 1 when i is 0, the size decreasing monotonically in linear fashion as i increases and reaching 0 when i is T−1. Winc(i) shown in steps 1608 and 1610 is a window function wherein the size of the window is 0 when i is 0, the size increasing monotonically in linear fashion as i increases and reaching 1 when i is T−1.

Figure 18:
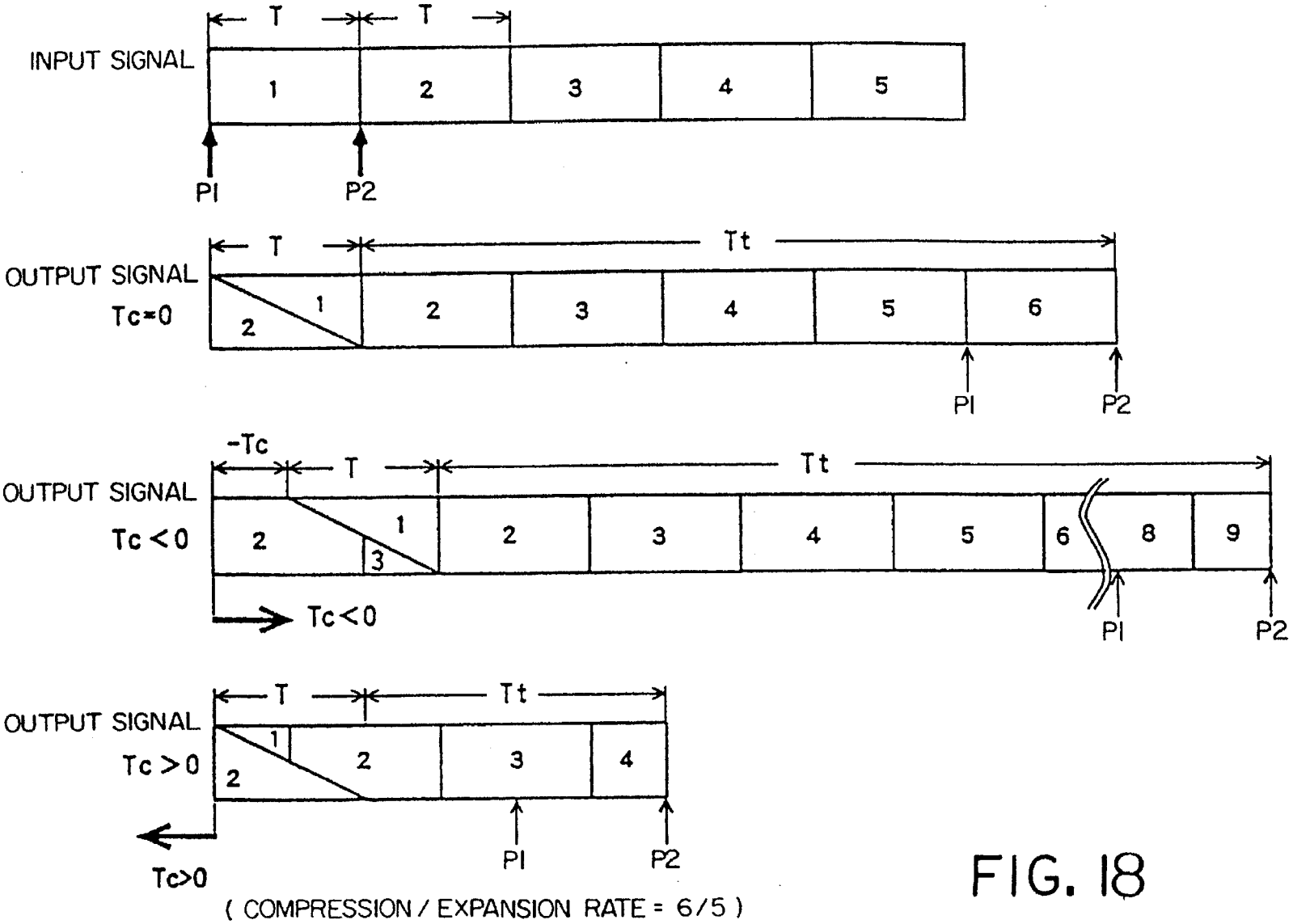
FIG. 18 is a schematic diagram showing an input signal and an output signal in the speech time-scale modification method according to the second embodiment of the invention.

FIG. 18 shows how the output signal is obtained in cases where the value of the time delay $T_c$ at which the value of the correlation function becomes the greatest is zero, where $T_c$ is positive, and where $T_c$ is negative. It can be seen that when the time delay $T_c$ is positive, $T_t$ is shorter than when $T_c$ is zero. Conversely, when $T_c$ is negative, $T_t$ is longer. This is because the length of $T_t$ is adjusted according to the displacement of $T_c$ in order to prevent the occurrence of a departure from the preset time-scale modification ratio $\alpha$. When the processing is to be continued, the addresses indicated by the input data pointers and output data pointer are updated as shown in step 1613, and then, the process starting with step 1602 is repeated.

According to the speech time-scale modification method mentioned above, a method of expanding the reproduction time (a method of reducing the reproduction speed without changing the pitch of speech) can be realized which has the features hereinafter described.

At step 1603, a value of the correlation function is calculated using the pointer P1 or P2 as the reference, and at step 1608 or 1610, the signal A or signal A' and the signal B' or signal B are weighted with the time delay $T_c$ at which the value of the correlation function becomes the greatest, and then added together. This prevents a significant phase mismatch from occurring between the segments where the signals are connected together.

At step 1608 or 1610, prior to the addition, the signal B' or B is multiplied by the window function Wdec(i) whose amplitude monotonically deceases with time, and the signal A or signal A' is multiplied by the window function Winc(i) whose amplitude monotonically increases with time. This ensures a good amplitude continuity between the segments where the signals are connected together. With the above operations, reproduction of smooth, natural, and clear sound, without significant loss of information and with reduced echo effects, can be achieved, which was not possible with the prior art.

It should also be noted that at step 1605, the time length $T_c$ during which the input signal succeeding the signal A or signal A' is directly output after the weight addition is calculated on the basis of the time delay $T_c$ at which the value of the correlation function becomes the greatest, so that a change in $T_c$ does not cause a displacement of the time-scale modification ratio $\alpha$ of the actual output signal.

Furthermore, the length of the segment along which the weight addition is performed at step 1608 or 1610 is fixed to a constant length T which is independent of the input signal or the time delay $T_c$, so that there is no possibility of the cross-fade length being reduced because of the value of $T_c$. The resulting reproduction sound is thus characterized by smooth low-frequency components contained in the signals connected together.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An apparatus for transforming an input signal having a time length L into an output signal having a time length L in accordance with a given time-scale modification ratio $\alpha$, said apparatus comprising:

input means for inputting a first signal which has a time length T and a second signal which has said time length T and succeeds said first signal;

correlating means for calculating a value of a correlation function between said first signal and said second signal and for determining a time delay $T_c$ at which said value of said correlation function becomes the greatest;

window function generating means for generating a first window function and a second window function according to said time-scale modification ratio $\alpha$ and said time delay $T_c$;

first multiplying means for multiplying said first signal by said first window function;

second multiplying means for multiplying said second signal by said second window function;

adding means for adding the output of said first multiplying means to the output of said second multiplying means with a displacement of said time delay $T_c$; and outputting means for selectively outputting the output of said adding means and a third signal succeeding said output of said adding means so that the sum of a time length of said output of said adding means and a time length of said third signal is substantially equal to a time length defined by $\alpha(T-T_c)/(\alpha-1)$ or $\alpha(T-T_c)/(1-\alpha)$.

2. A method for transforming an input signal having a time length L into an output signal having a time length $\alpha L$ in accordance with a given time-scale modification ratio $\alpha$, said method comprising the steps of:

(a) inputting a first signal which has a time length T from a starting point and a second signal which has said time length T and succeeds said first signal;

(b) calculating a value of a correlation function between said first signal and said second signal and determining a time delay $T_c$ at which said value of said correlation function becomes the greatest;

(c) generating a first window function and a second window function according to said time-scale modification ratio $\alpha$ and said time delay $T_c$;

(d) obtaining a first multiplied result by multiplying said first signal by said first window function;

(e) obtaining a second multiplied result by multiplying said second signal by said second window function;

(f) obtaining an added result by adding said first multiplied result to said second multiplied result with a displacement of said time delay $T_c$;

(g) selectively outputting said added result and a third signal succeeding said added result so that the sum of a time length of said added result and a time length of said third signal is substantially equal to a predetermined first time length defined by $\alpha(T-T_c)/(\alpha-1)$ or $\alpha(T-T_c)/(1-\alpha)$;

(h) adding a predetermined second time length defined by said time-scale modification ratio $\alpha$, said time delay $T_c$ and said time length T to said starting point of said first signal; and (i) repeating said step (a) to said step (h).

3. A method according to claim 2, wherein said time-scale modification ratio $\alpha$ satisfies a condition of $\alpha \geqq 1$, said first window function monotonically increases and said second window function monotonically decreases in a manner complementary to said first window function, said predetermined first time length is represented by $\alpha(T-T_c)/(\alpha-1)$, said third signal is a signal exceeding said first signal, said predetermined second time length is represented by $(T-T_c)/(\alpha-1)$.

4. A method according to claim 2, wherein said time-scale modification ratio $\alpha$ satisfies a condition of $\alpha \leqq 1$, said first window function monotonically decreases and said second window function monotonically increases in a manner complementary to said first window function, said predetermined first time length is represented by an equation of $\alpha(T-T_c)/(1-\alpha)$, said third signal is a signal exceeding said second signal, said predetermined second time length is represented by an equation of $(T-T_c)/(1-\alpha)$.

5. An apparatus for transforming an input signal having a time length L into an output signal having a time length $\alpha L$ in accordance with a given time-scale modification ratio $\alpha$, said apparatus comprising:

input means for inputting a first signal which has a time length M ($T \leqq M < 2T$) and a second signal which has said time length M, a starting point of said second signal being delayed from a starting point of said first signal by a time length T;

correlating means for calculating a value of a correlation function between said first signal and said second signal and for determining a time delay $T_c$ at which said value of said correlation function becomes the greatest;

window function generating means for generating a first window function and a second window function according to said time-scale modification ratio $\alpha$ and said time delay $T_c$;

reading means for reading a portion of said first signal and a portion of said second signal according to said time delay $T_c$;

first multiplying means for multiplying said portion of said first signal by said first window function;

second multiplying means for multiplying said portion of said second signal by said second window function;

adding means for adding the output of said first multiplying means to the output of said second multiplying means with a displacement of said time delay $T_c$ and with an overlap of said time length T; and outputting means for selectively outputting the output of said adding means and a third signal succeeding said output of said adding means so that the sum of a time length of said output of said adding means and a time length of said third signal is substantially equal to a time length defined by said time-scale modification ratio $\alpha$, said time delay $T_c$ and said time length T.

6. A method for transforming an input signal having a time length L into an output signal having a time length $\alpha L$ in accordance with a given time-scale modification ratio $\alpha$ which satisfies a condition of $\alpha \geqq 1$, said method comprising the steps of:

(a) inputting a first signal which has a time length T from a starting point and a second signal which has said time length T and succeeds said first signal;

(b) calculating a value of a correlation function between said first signal and said second signal and determining a time delay $T_c$ at which said value of said correlation function becomes the greatest;

(c) obtaining a third signal which has said time length T and delays from said first signal by said time delay $T_c$ and a fourth signal which has said time length T and delays from said second signal by said time delay $(-T_c)$;

(d) generating a first window function which monotonically increases and a second window function which monotonically decreases in a manner complementary to said first window function according to said time-scale modification ratio $\alpha$ and said time delay $T_c$;

(e) performing a first output step, when said time delay $T_c$ satisfies a condition of $T_c<0$, said first step including the steps of:

(e1) obtaining a fifth signal which has said time length $(-T_c)$ from a start point of said second signal;

(e2) obtaining a first multiplied result by multiplying said first signal by said first window function;

(e3) obtaining a second multiplied result by multiplying said fourth signal by said second window function;

(e4) obtaining an added result by adding said first multiplied result to said second multiplied result; and (e5) selectively outputting said fifth signal, said added result and a sixth signal succeeding said first signal so that the sum of a time length of said fifth signal, a time length of said added result and a time length of said sixth signal is substantially equal to a predetermined first time length defined by said time-scale modification ratio $\alpha$, said time delay $T_c$ and said time length T;

(f) performing a second output step, when said time delay $T_c$ satisfies a condition of $T_c \geqq 0$, said second step including the steps of:

(f1) obtaining a first multiplied result by multiplying said third signal by said first window function;

(f2) obtaining a second multiplied result by multiplying said second signal by said second window function;

(f3) obtaining an added result by adding said first multiplied result to said second multiplied result; and (f4) selectively outputting said added result and a seventh signal succeeding said third signal so that the sum of a time length of said added result and a time length of said seventh signal is substantially equal to a predetermined first time length defined by said time-scale modification ratio $\alpha$, said time delay $T_c$ and said time length T;

(g) adding a predetermined second time length defined by said time-scale modification ratio $\alpha$, said time delay $T_c$ and said time length T to said starting point of said first signal; and (h) repeating said step (a) to said step (g).

7. A method according to claim 6, wherein said predetermined first time length is represented by an equation of $\alpha(T-T_c)/(\alpha-1)$ and said predetermined second time length is represented by an equation of $(T-T_c)/(\alpha-1)$.

8. A method according to claim 6, wherein said step (b) includes the steps of:

calculating a value of a correlation function between said first signal and a signal which has said time length T and delays from said second signal by $(-\tau)$ for $-T<\tau<0$;

calculating a value of said correlation function between said second signal and a signal which has said time length T and delays from said first signal by $\tau$ for $0 \leqq \tau < T$;

determining a time delay $T_c$ at which said value of said correlation function becomes the greatest for $-T<\tau<T$.

9. A method according to claim 8, wherein said correlation function is defined by:

$$R(\tau)=\sum_{m=0}^{T-1} x(ip1+m)\cdot x(ip2-\tau+m)$$

for $-T<\tau<0$; and $$R(\tau)=\sum_{m=0}^{T-1} x(ip1+\tau+m)\cdot x(ip2+m)$$

for $0 \leqq \tau < T$;

where, ip1 denotes a starting point of said first signal and ip2 denotes a stating point of said second signal.

10. A method for transforming an input signal having a time length L into an output signal having a time length $\alpha L$ in accordance with a given time-scale modification ratio $\alpha$ which satisfies a condition of $\alpha \leqq 1$, said method comprising the steps of:

(a) inputting a first signal which has a time length T from a starting point and a second signal which has said time length T and succeeds said first signal;

(b) calculating a value of a correlation function between said first signal and said second signal and determining a time delay $T_c$ at which said value of said correlation function becomes the greatest;

(c) obtaining a third signal which has said time length T and delays from said first signal by said time delay $T_c$ and a fourth signal which has said time length T and delays from said second signal by said time delay $(-T_c)$;

(d) generating a first window function which monotonically decreases and a second window function which monotonically increases in a manner complementary to said first window function according to said time-scale modification ratio $\alpha$ and said time delay $T_c$;

(e) performing a first output step, when said time delay $T_c$ satisfies a condition of $T_c>0$, said first step including the steps of:

(e1) obtaining a fifth signal which has said time length $T_c$ from a start point of said first signal;

(e2) obtaining a first multiplied result by multiplying said third signal by said first window function;

(e3) obtaining a second multiplied result by multiplying said second signal by said second window function;

(e4) obtaining an added result by adding said first multiplied result to said second multiplied result; and (e5) selectively outputting said fifth signal, said added result and a sixth signal succeeding said second signal so that the sum of a time length of said fifth signal, a time length of said added result and a time length of said sixth signal is substantially equal to a predetermined first time length defined by said time-scale modification ratio $\alpha$, said time delay $T_c$ and said time length T;

(f) performing a second output step, when said time delay $T_c$ satisfies a condition of $T_c \leqq 0$, said second step including the steps of:

(f1) obtaining a first multiplied result by multiplying said first signal by said first window function;

(f2) obtaining a second multiplied result by multiplying said fourth signal by said second window function;

(f3) obtaining an added result by adding said first multiplied result to said second multiplied result; and (f4) selectively outputting said added result and a seventh signal succeeding said fourth signal so that the sum of a time length of said added result and a time length of said seventh signal is substantially equal to a predetermined first time length defined by said time-scale modification ratio $\alpha$, said time delay $T_c$ and said time length T;

(g) adding a predetermined second time length defined by said time-scale modification ratio $\alpha$, said time delay $T_c$ and said time length T to said starting point of said first signal; and (h) repeating said step (a) to said step (g).

11. A method according to claim 10, wherein said predetermined first time length is represented by an equation of $\alpha(T-T_c)/(1-\alpha)$ and said predetermined second time length is represented by an equation of $(T-T_c)/(1-\alpha)$.

12. A method according to claim 10, wherein said step (b) includes the steps of:

calculating a value of a correlation function between said first signal and a signal which has said time length T and delays from said second signal by $(-\tau)$ for $-T<\tau<0$;

calculating a value of said correlation function between said second signal and a signal which has said time length T and delays from said first signal by $\tau$ for $0\leqq\tau<T$;

determining a time delay $T_c$ at which said value of said correlation function becomes the greatest for $-T<\tau<T$.

13. A method according to claim 12, wherein said correlation function is defined by:

$$R(\tau)=\sum_{m=0}^{T-1} x(ip1+m)\cdot x(ip2-\tau+m)$$

for $-T<\tau<0$; and $$R(\tau)=\sum_{m=0}^{T-1} x(ip1+\tau+m)\cdot x(ip2+m)$$

for $0\leqq\tau<T$;

where, ip1 denotes a starting point of said first signal and ip2 denotes a stating point of said second signal.

* * * * *